US012202576B2

(12) United States Patent
Kim

(10) Patent No.: US 12,202,576 B2
(45) Date of Patent: Jan. 21, 2025

(54) WINGED BOAT

(71) Applicant: Jongcheol Kim, Namyangju-si (KR)

(72) Inventor: Jongcheol Kim, Namyangju-si (KR)

( * ) Notice: Subject to any disclaimer, the term of this patent is extended or adjusted under 35 U.S.C. 154(b) by 470 days.

(21) Appl. No.: 17/697,109

(22) Filed: Mar. 17, 2022

(65) Prior Publication Data

US 2022/0297800 A1 Sep. 22, 2022

(30) Foreign Application Priority Data

Mar. 18, 2021 (KR) ..... 10-2021-0035196
Aug. 3, 2021 (KR) ..... 10-2021-0102153

(51) Int. Cl.
*B63B 17/04* (2006.01)
*B63B 43/14* (2006.01)
*B63B 43/18* (2006.01)

(52) U.S. Cl.
CPC ..... *B63B 17/04* (2013.01); *B63B 43/14* (2013.01); *B63B 43/18* (2013.01); *B63B 2231/44* (2013.01)

(58) Field of Classification Search
CPC .. B63B 1/244; B63B 1/30; B63B 1/32; B63B 1/322; B63B 1/248; B63B 17/04; B63B 43/06; B63B 43/14; B63B 43/18; B63B 2043/042; B63B 2231/44; B63B 3/08; B63B 7/04; B63B 2007/003; B63B 9/28; B63B 39/062; B63H 5/02; B63H 16/12
USPC ..... 114/272
See application file for complete search history.

(56) References Cited

U.S. PATENT DOCUMENTS 3,636,906 A * 1/1972 Wray ..... B63B 1/18 114/288
3,960,103 A * 6/1976 Rey ..... B64C 39/08 440/12.5
11,279,463 B2 * 3/2022 Witt ..... B64C 3/185

FOREIGN PATENT DOCUMENTS

JP 2009-132369 A 6/2009
KR 10-1998-0031062 A 7/1998
KR 20-1999-0034657 U 8/1999
KR 10-2003-0010961 A 2/2003
KR 10-1773596 B1 8/2017
KR 10-2017-0103430 A 9/2017

* cited by examiner

*Primary Examiner* — Daniel V Venne
(74) *Attorney, Agent, or Firm* — KORUS Patent, LLC; Seong Il Jeong

(57) ABSTRACT

The present invention relates to a winged boat comprising a main body including a passenger space and a closed space at an edge, buoyant wing parts protruding from both sides of the main body, disposed in a front and a rear area of the main body, and each including a wing body protruded from a side of the main body; a buoyant space formed inside the wing body in a closed state; a water storage part disposed in an opposite direction to the main body with respect to the buoyant space and having an opening and closing part at a lower portion and an inlet formed at an upper portion, and a buoyancy control part provided in an opposite direction to the buoyant space with respect to the water storage part and adjusting buoyancy of the wing body by controlling an amount of water stored therein.

8 Claims, 17 Drawing Sheets

WINGED BOAT

FIELD OF THE INVENTION

The present invention relates to a winged boat, and more particularly, to a winged boat capable of preventing the boat from tilting or capsizing due to various factors.

BACKGROUND OF THE INVENTION

In general, a boat is used for enjoying water sports such as swimming or fishing in the sea, river, or lake. A motorboat using a mechanical power source or a non-motorized boat using human power are widely used.

A conventional boat includes a body with buoyancy so that it can float on the water surface, a passenger space formed in the upper portion of the body so that a passenger can board and be accommodated, and a handrail structure along the edge of the passenger space to prevent a passenger from falling overboard. In addition, the boat is further provided with a lifesaving appliance that a passenger can board on or wear to prepare for sinking accidents. However, the conventional boat has a risk of capsizing due to a change in a center of gravity when it tilts beyond a certain angle due to waves or strong winds. In addition, when the boat moves, there are risks that a passenger may fall overboard, or water may be introduced into the passenger space.

Therefore, there is a need for a technology capable of maintaining the boat at a stable angle when the boat greatly moves due to various factors.

Korean Utility Model Publication No. 20-1999-0034657 (Aug. 25, 1999) is a prior document related to the present invention and discloses a motorboat.

DETAILED DESCRIPTION OF THE INVENTION

Technical Problems

The object of the present invention is to provide a winged boat capable of preventing the boat from tilting or capsizing due to various factors.

SUMMARY OF THE INVENTION

A winged boat according to the present invention comprises: a main body with buoyancy, including a passenger space formed on an upper portion thereof and a closed space formed at an edge thereof, buoyant wing parts protruding from both sides of the main body, respectively disposed in a front area and a rear area of the main body to be spaced apart from each other, and each including: a wing body protruded from a side of the main body with a certain length; a buoyant space formed inside the wing body in a closed state; a water storage part disposed in an opposite direction to the main body with respect to the buoyant space and having an opening and closing part operably provided at a lower portion thereof and an inlet formed at an upper portion thereof, and a buoyancy control part provided in an opposite direction to the buoyant space with respect to the water storage part and adjusting buoyancy of the wing body by controlling an amount of water stored therein.

In addition, the buoyancy control part may include: a storage space formed in an opposite direction to the buoyant space with respect to the water storage part; an air passage extending from the storage space, exposed to an upper portion of the wing body, and communicating between the storage space and the outside of the wing body; a water entrance vertically penetrating an upper portion of the storage space; a lifting member provided in the inside of the storage space in an elevatable way, discharging water W stored in the storage space through the water entrance when ascending, and discharging air in the storage space to the outside through the air passage when descending; a control member provided in the main body to be rotatably operable, and a connecting cable having one longitudinal end connected to a top end of the lifting member and the other end wound around an outer side of the control member.

Furthermore, the buoyancy control part may be formed in an opposite direction to the buoyant space with respect to the water storage part and includes: an installation groove a lower portion of which is vertically open downward; a tube coupled to the inside of the installation groove 251, being capable of being expandable and contractible in a vertical direction, and having an accommodating space inside; a water entrance penetrating vertically through an upper portion of the tube; a plurality of air pumps provided in the main body and sucking or discharging air; a connecting pipe having one longitudinal end that is connected to a top end of the tube and the other end that is opposite to the longitudinal end of the connecting pipe and connected to the air pump.

Moreover, the winged boat further may comprise a buoyant body connecting ring provided at an outer side of the buoyant wing part for coupling a substitute buoyant body; a buffer member provided at a protruding end of the buoyant wing part, having a buffer space formed inside, and made of an elastic material to be expandable and contractible, and an auxiliary opening and closing part provided at one side of the buffer member, wherein the buffer member injects water to the inside or discharges water to the outside by opening or closing the auxiliary opening and closing part.

In addition, the main body may include: a front body positioned in a front portion; a rear body positioned in a rear portion, and one or more connecting block coupled between the front body and the rear body.

Furthermore, the main body further may include: a mounting groove concavely formed on both sides of the main body and having a length in a front and rear direction, wherein one longitudinal end of the wing body is rotatably coupled to a vertical rotation center formed in a front or a rear portion of the mounting groove, and when the wing body rotates toward a longitudinal direction of the main body, a width directional portion of the wing body is inserted into the mounting groove.

Moreover, the winged boat further may comprise: an insertion groove concavely formed on both sides of the main body and a locking shoulder protruding from an inner circumferential surface of the insertion groove, wherein one longitudinal end of the wing body is slidably inserted into the insertion groove and has a locking protrusion protruding in its width direction, and when the wing body is slidingly withdrawn from the insertion groove, the locking protrusion is hooked on the locking shoulder, thereby limiting a withdrawn length of the wing body.

In addition, the winged boat further may comprise a stopper that is provided on an upper portion of the inlet in a combinable and detachable way, wherein the stopper seals the water storage part when coupled to the inlet, and the stopper opens the water storage part upward when separated from the inlet.

Furthermore, the winged boat further may comprise a plurality of auxiliary buoyancy control parts coupled to a lower portion of the main body, wherein the auxiliary buoyancy control parts are made of an elastic material to be stretchable and provided with an inlet and an outlet that can be open and close for selectively injecting water or air.

Moreover, a propulsive force generating part may include: a pair of rotating shafts forming horizontal rotation centers on both sides of the main body in a left and a right direction; a pair of rotating blades parts rotatably installed on the rotating shafts, and a pair of rotating levers provided on both sides of the passenger space to be rotatably operable and mechanically connected to the rotating shafts, respectively, In addition, the winged boat further may comprise: a water play tube into which air is injected; a life jacket that has buoyancy and can be worn on a user's upper body; a seat belt storage box provided in the passenger space 110 and accommodating a seat belt therein; a buoyancy body connecting ring provided in the water play tube for coupling a substitute buoyancy body; a first buoyancy air box provided along an edge of the water play tube, made of an elastic material to be stretchable, and having a water entrance to be open and close for selectively injecting water or air, wherein the first buoyancy air box is provided with a stretchable air balloon formed inside and a water storage part formed inside for storing water, and a second buoyancy air box provided in the life jacket and made of an elastic material to be stretchable, wherein the second buoyancy air box is provided with an inlet and an outlet that can be open and close for selectively injecting water or air.

Technical Effects of the Invention

The present invention can prevent the boat from losing its balance and tilting or capsizing due to various factors such as strong wind and flooding, thereby preventing boating accidents in advance. In addition, since the buoyant wing part can be accommodated in a reduced volume, it can be easily stored and transported. Furthermore, the reduced volume of the buoyant wing part can reduce frictional resistance from water during operation, and thus the speed of the boat can increase.

In addition, since the buffer member of the buoyant wing part of the present invention buffers an external impact, the buoyant wing part can be prevented from damage caused by impacts of surrounding structures. In addition, since the length of the main body may change according to the number of passengers, the boat can be used conveniently.

DETAILED DESCRIPTION

Hereinafter, preferred embodiments according to the present invention will be described in detail in conjunction with the accompanying drawings.

Advantages and features of the present invention and a method of achieving the same will become apparent with reference to the embodiments described below in conjunction with the accompanying drawings.

However, the present invention is not limited by the embodiments disclosed below but will be implemented in a variety of different forms. The embodiments allow the disclosure of the present invention to be complete and is provided to fully inform those of ordinary skill in the technical field to which the present invention pertains, and the present invention is defined only by the scope of the claims.

In addition, in the description of the present invention, if it is determined that related known technologies may obscure the gist of the present invention, a detailed description thereof will be omitted.

Figure 1:
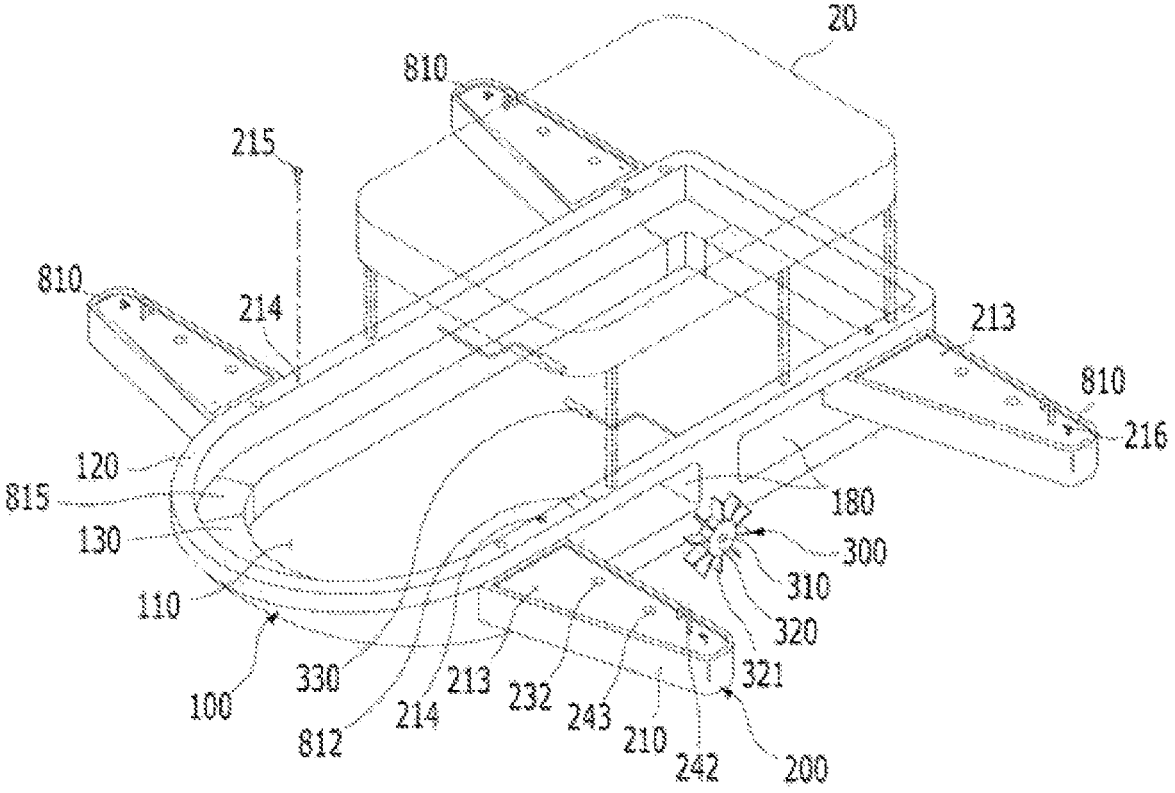
FIG. 1 is a perspective view illustrating a winged boat according to the present invention.
Figure 2:
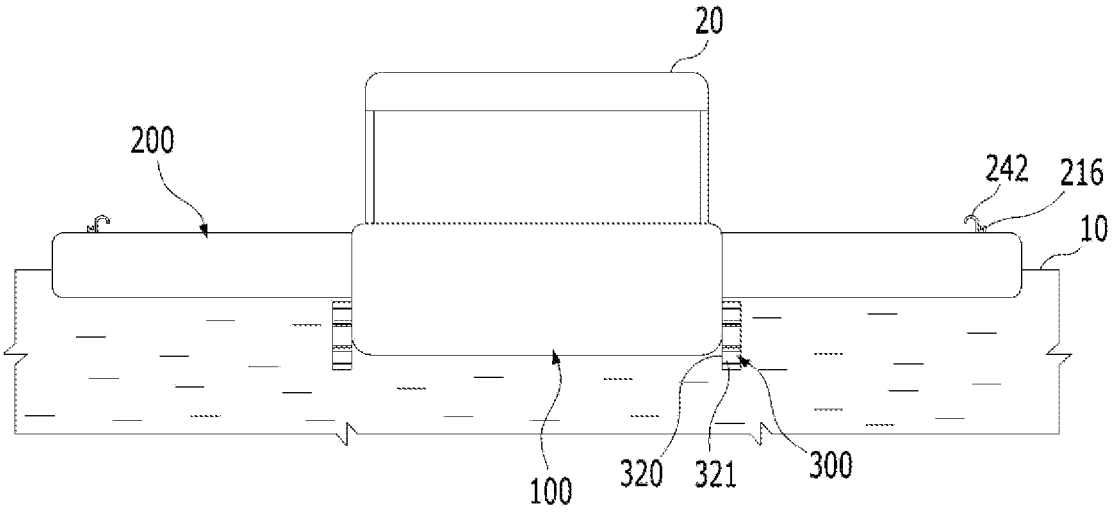
FIG. 2 is a front view illustrating a winged boat according to the present invention.
Figure 3:
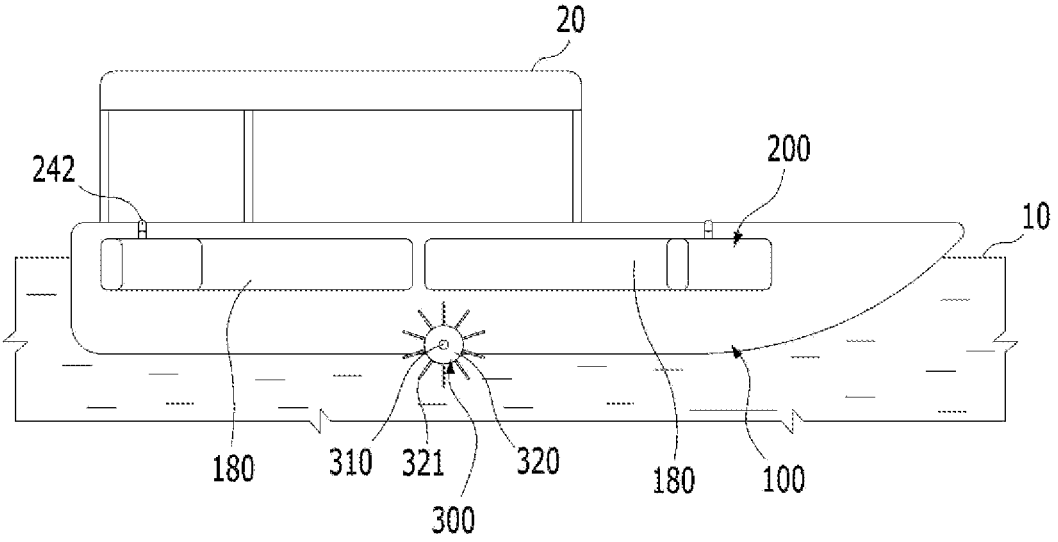
FIG. 3 is a side view illustrating a winged boat according to the present invention.
Figure 4:
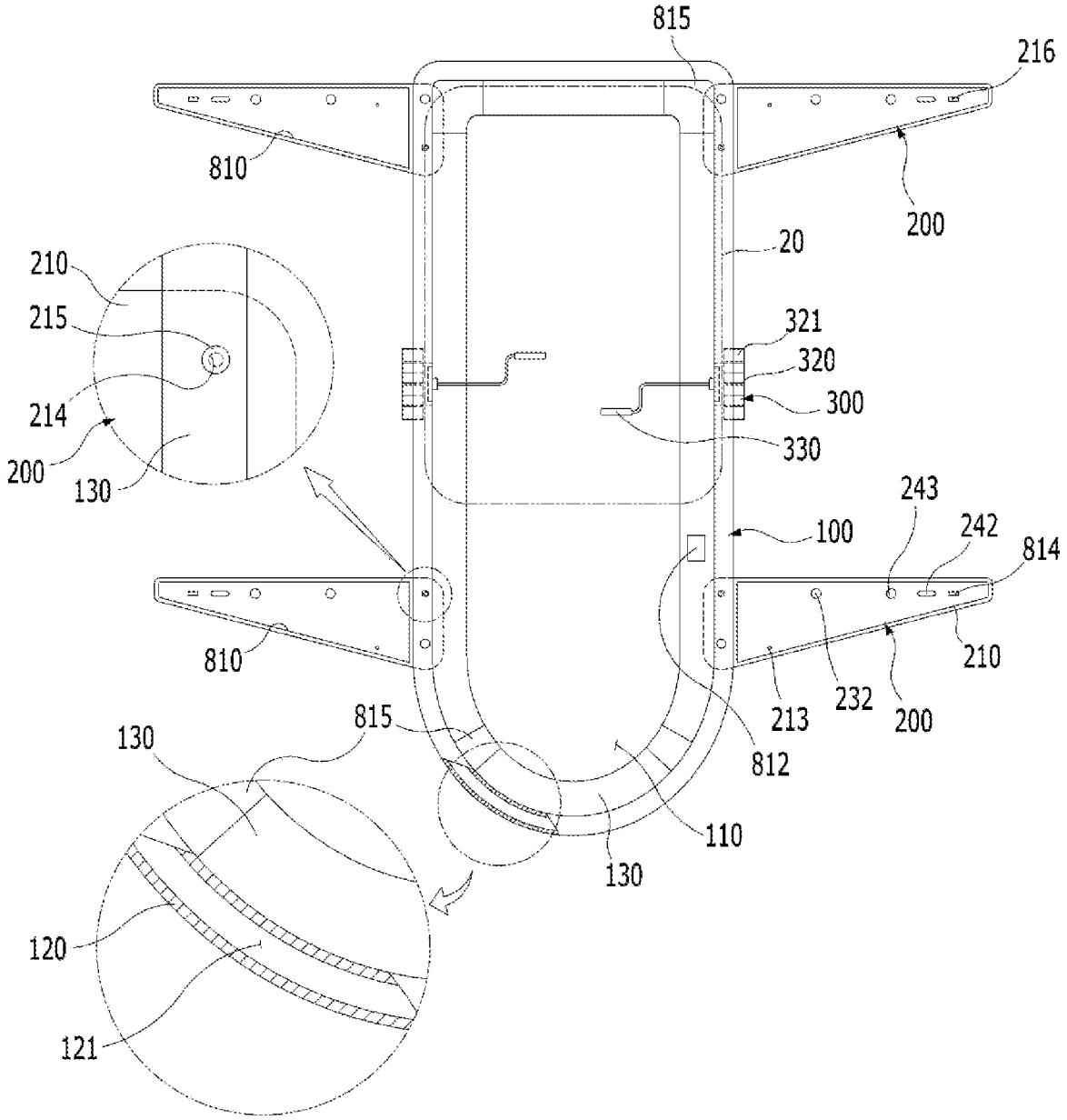
FIG. 4 is a top view illustrating a winged boat according to the present invention.
Figure 5:
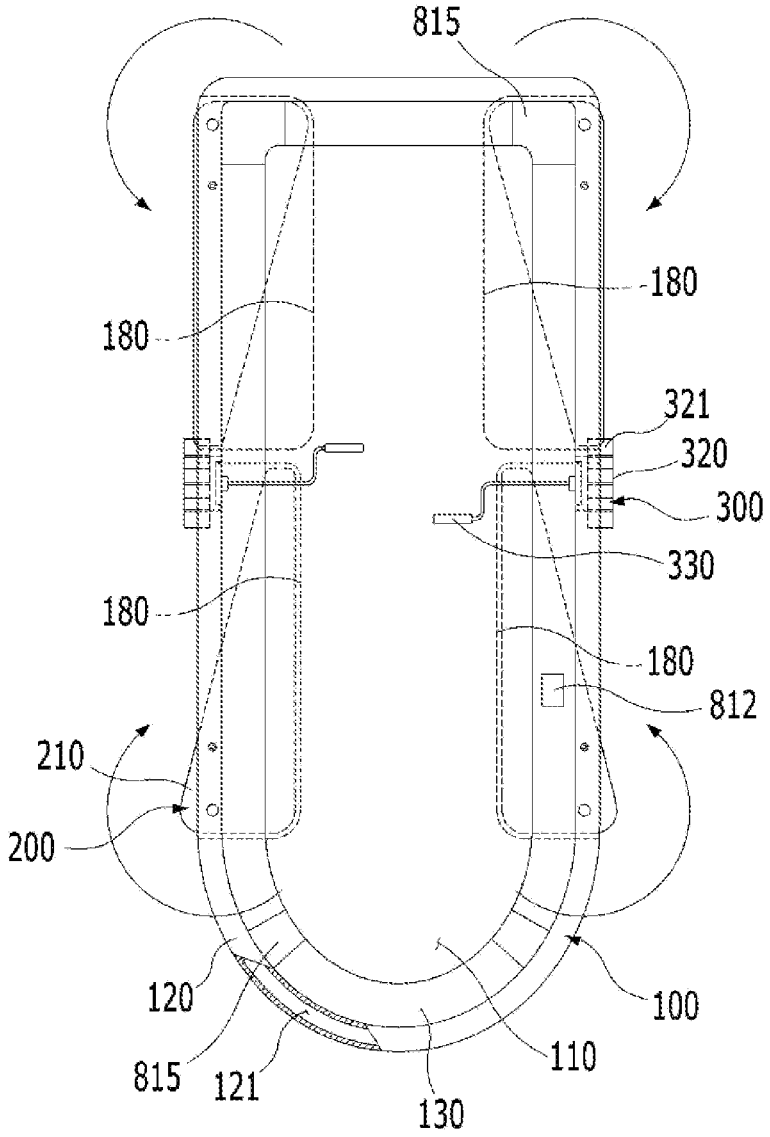
FIG. 5 is a top view illustrating a folded state of buoyant wing part of the winged boat according to the present invention.
Figure 6:
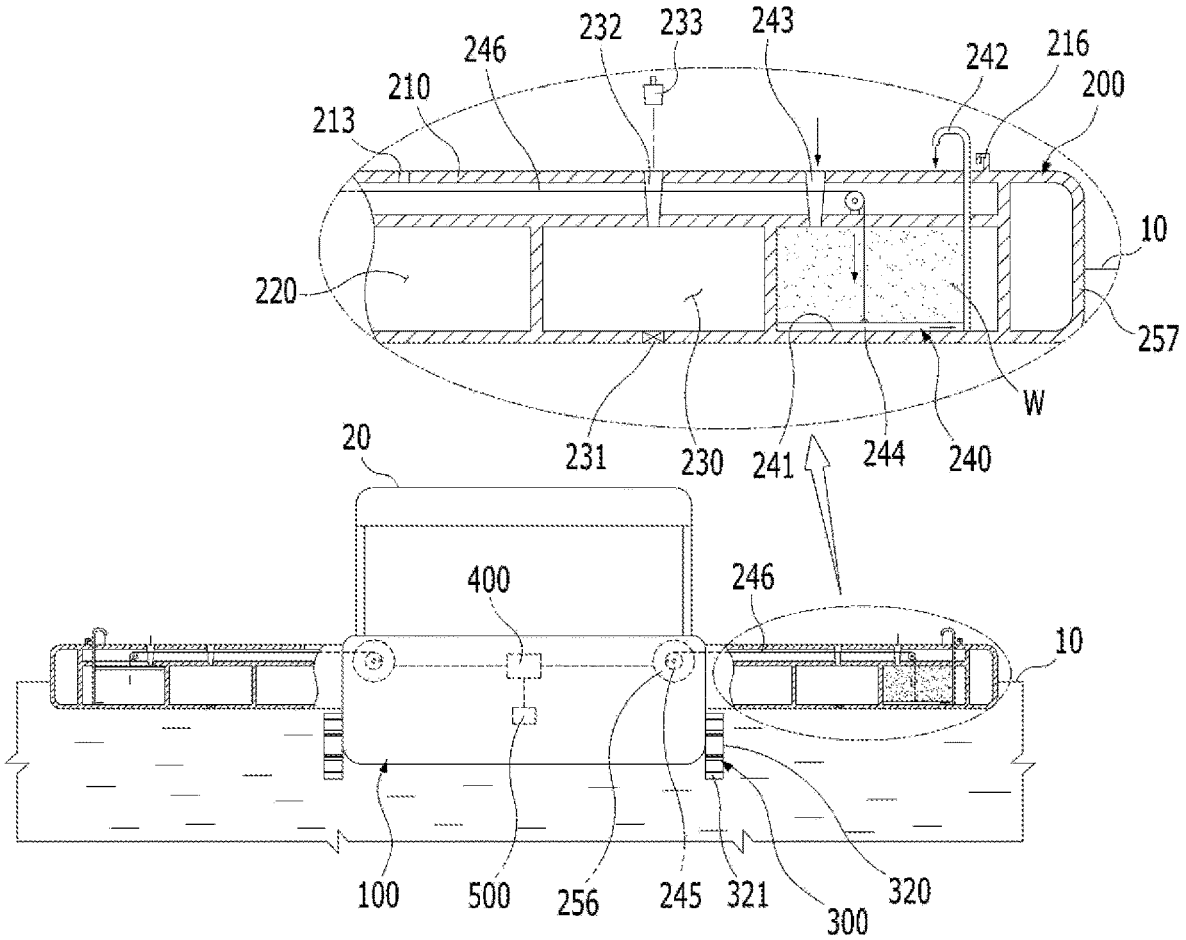
FIG. 6 is a front cross sectional view illustrating a descent state of a lifting member of a buoyancy control part in the winged boat according to the present invention.

FIG. 1 is a perspective view illustrating a winged boat according to the present invention. FIG. 2 is a front view illustrating a winged boat according to the present invention. FIG. 3 is a side view illustrating a winged boat according to the present invention. FIG. 4 is a top view illustrating a winged boat according to the present invention. FIG. 5 is a top view illustrating a folded state of buoyant wing part of the winged boat according to the present invention. FIG. 6 is a front cross sectional view illustrating a descent state of a lifting member of buoyancy control part in the winged boat according to the present invention.

Figure 7:
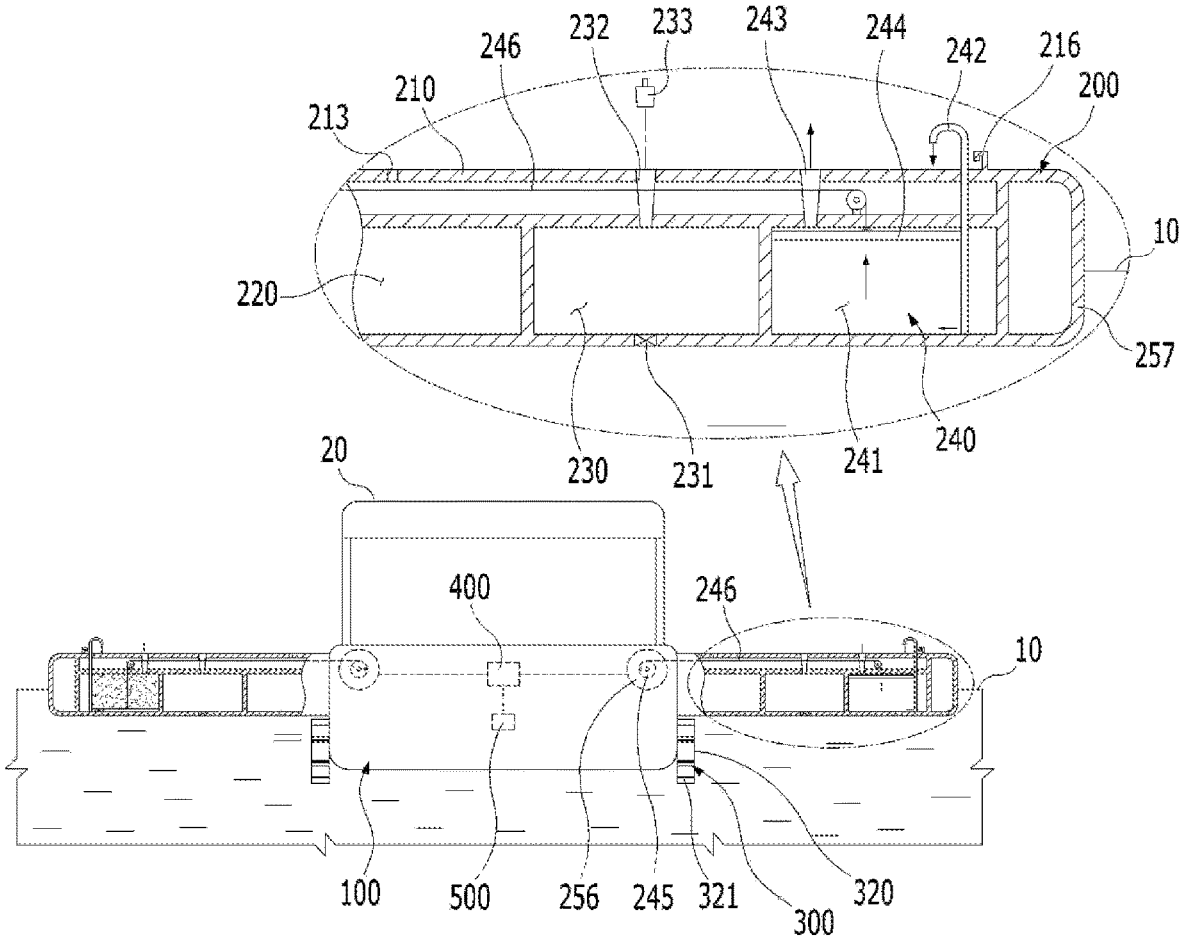
FIG. 7 is a front cross sectional view illustrating an ascent state of the lifting member of the buoyancy control part in the winged boat according to the present invention.
Figure 8:
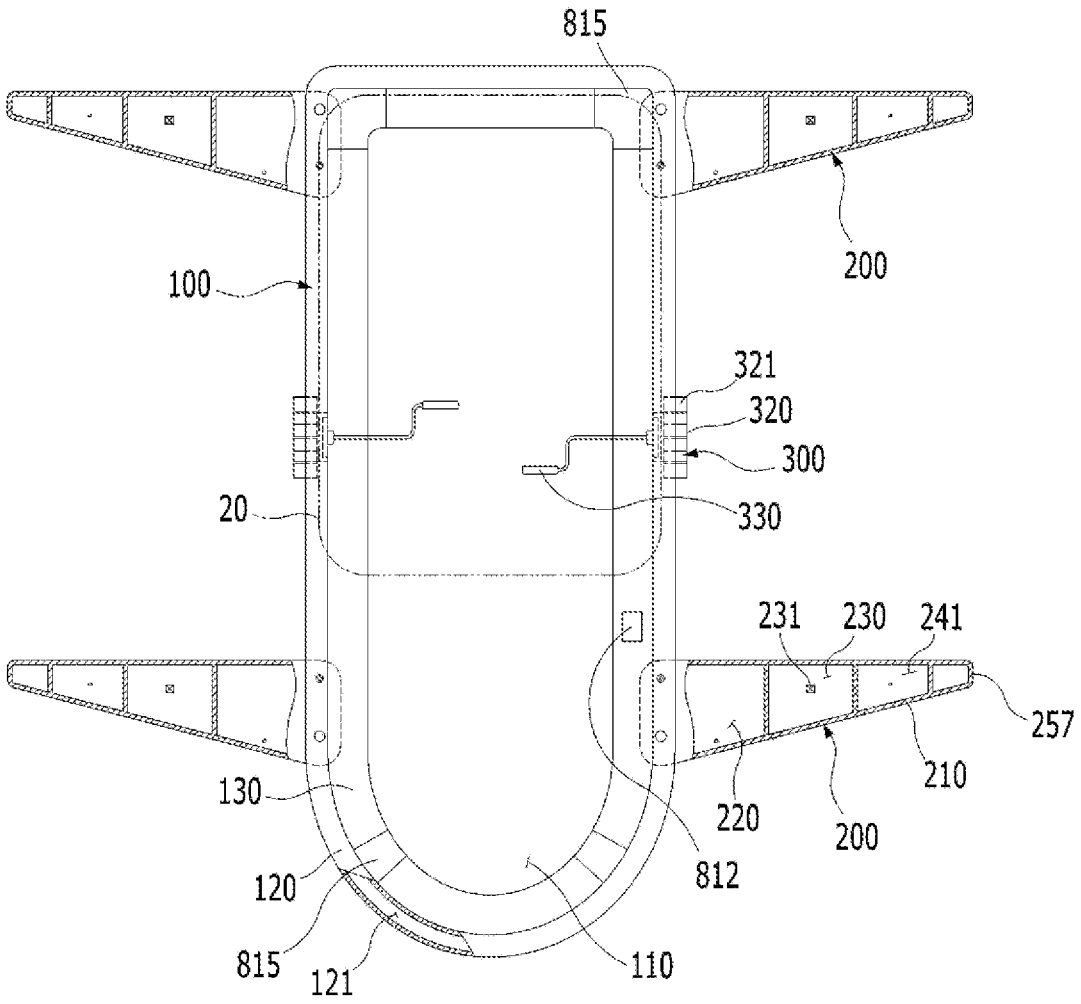
FIG. 8 is a top cross sectional view illustrating in detail the winged boat according to the present invention.
Figure 9:
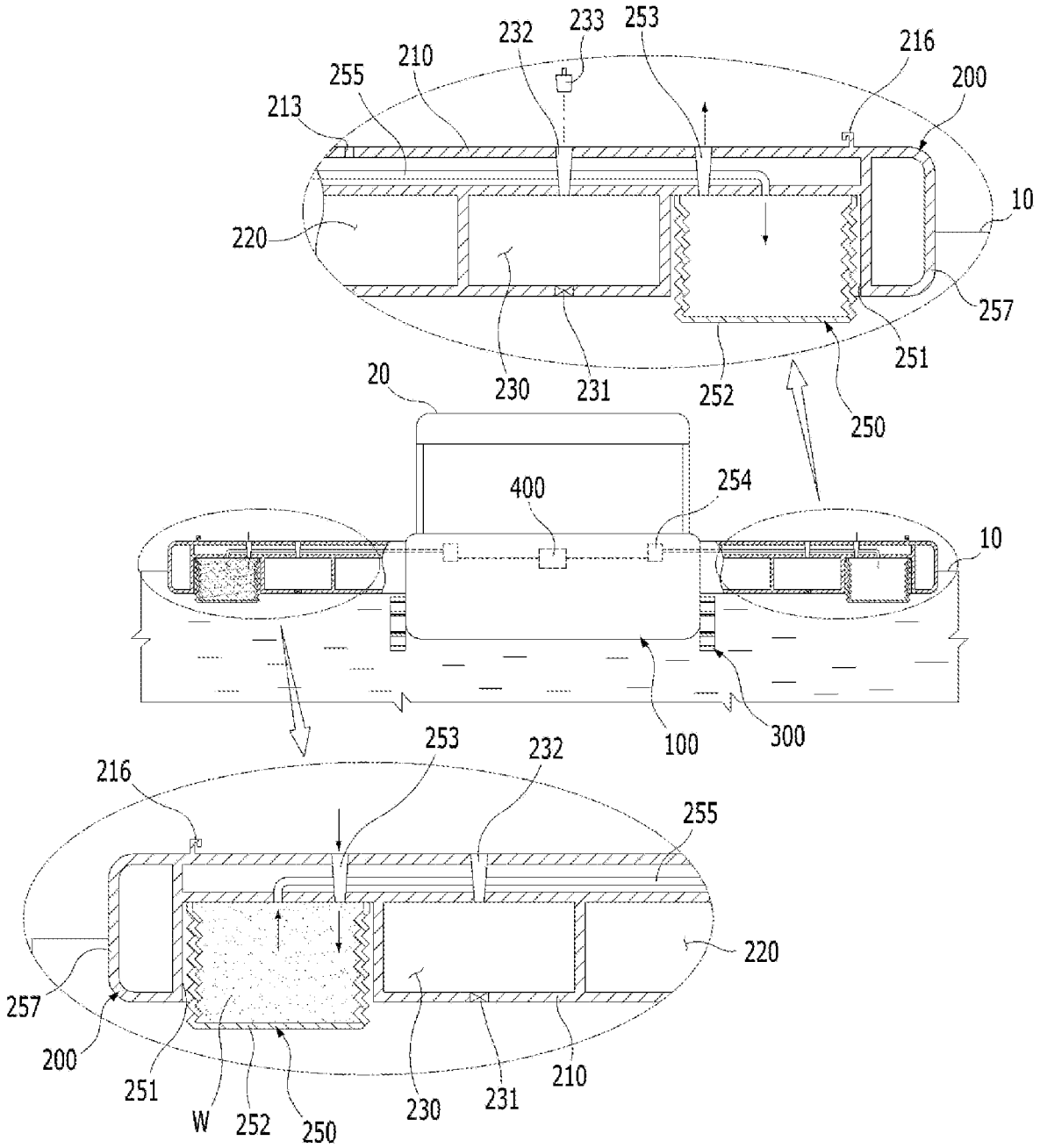
FIG. 9 is a front cross sectional view illustrating a state in which a tube is applied to the buoyancy control part in the winged boat according to the present invention.
Figure 10:
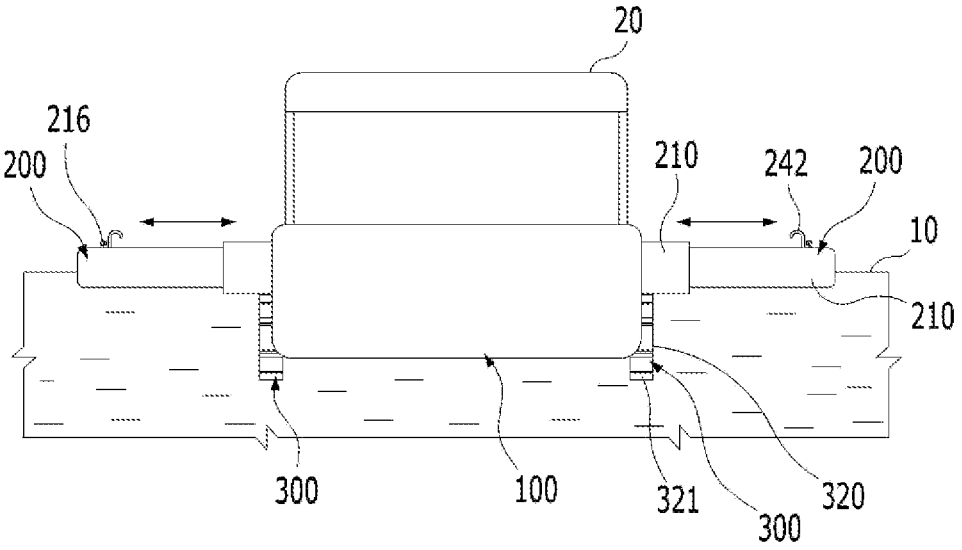
FIG. 10 is a front view illustrating a state in which buoyant wing part of the winged boat is applied in such a way that a length of the buoyant wing part is adjustable according to the present invention.
Figure 11:
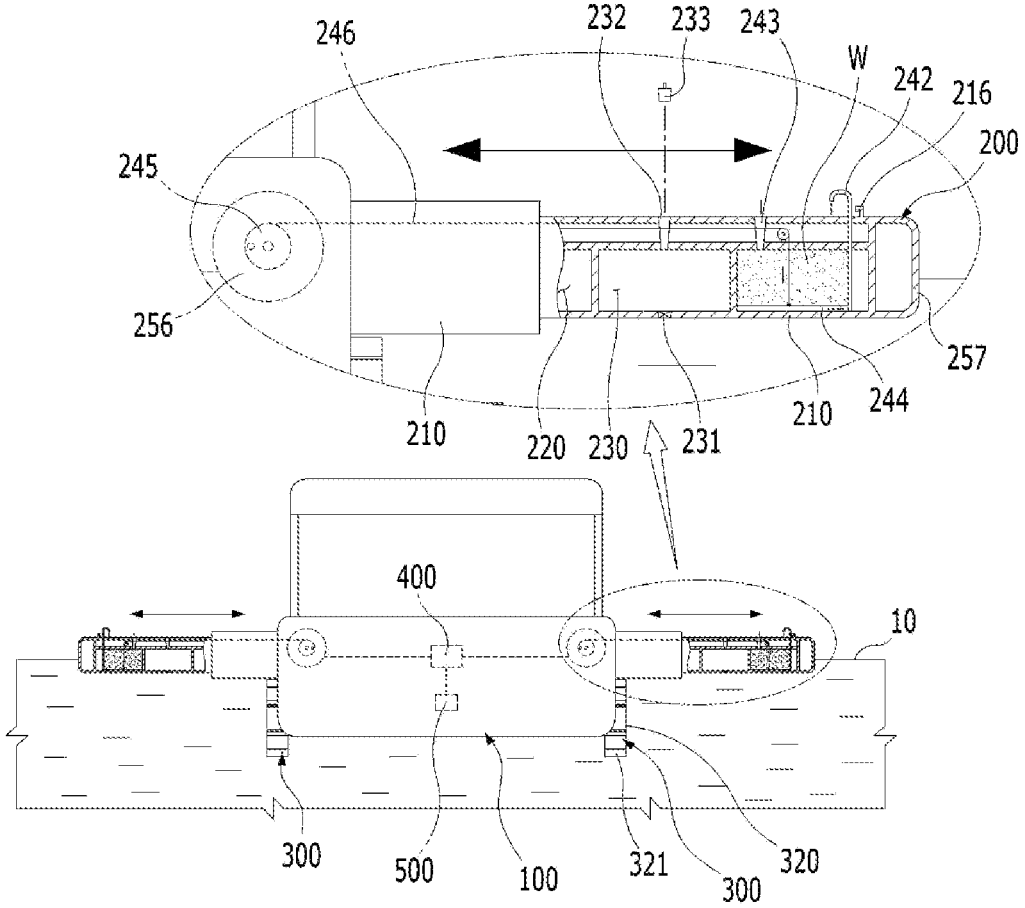
FIG. 11 is a front cross sectional view illustrating a state in which the buoyant wing part of the winged boat is applied in such a way that the length of the buoyant wing part is adjustable according to the present invention.
Figure 12:
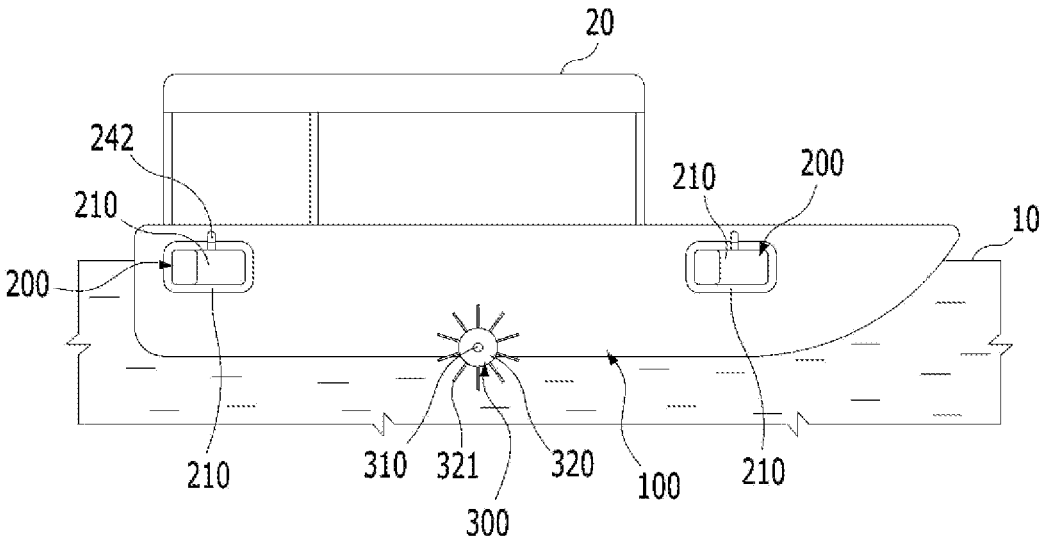
FIG. 12 is a side view illustrating a state in which the buoyant wing part of the winged boat is applied in such a way that the length of the buoyant wing part is adjustable according to the present invention.

FIG. 7 is a front cross sectional view illustrating an ascent state of the lifting member of the buoyancy control part in the winged boat according to the present invention. FIG. 8 is a top cross sectional view illustrating in detail the winged boat according to the present invention. FIG. 9 is a front cross sectional view illustrating a state in which a tube is applied to the buoyancy control part in the winged boat according to the present invention. FIG. 10 is a front view illustrating a state in which a buoyant wing part of the winged boat is applied in such a way that a length of the buoyant wing part is adjustable according to the present invention. FIG. 11 is a front cross sectional view illustrating a state in which the buoyant wing part of the winged boat is applied in such a way that the length of the buoyant wing part is adjustable according to the present invention. FIG. 12 is a side view illustrating a state in which the buoyant wing part of the winged boat is applied in such a way that the length of the buoyant wing part is adjustable according to the present invention.

Figure 13:
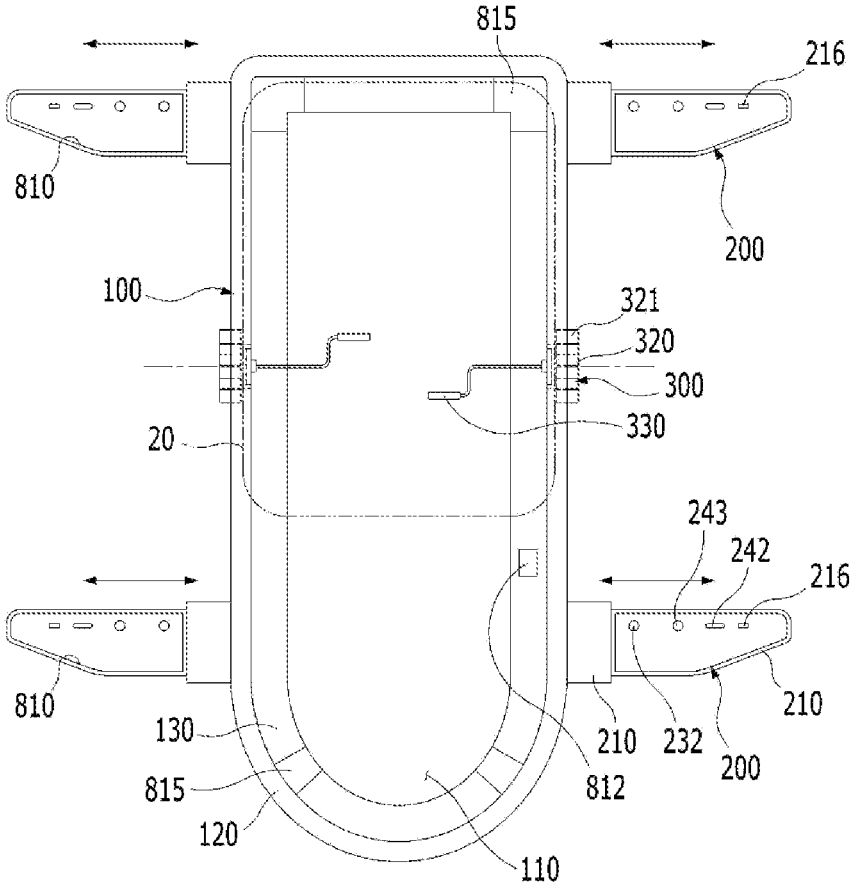
FIG. 13 is a top view illustrating a state in which the buoyant wing part of the winged boat is applied in such a way that the length of the buoyant wing part is adjustable according to the present invention.
Figure 14:
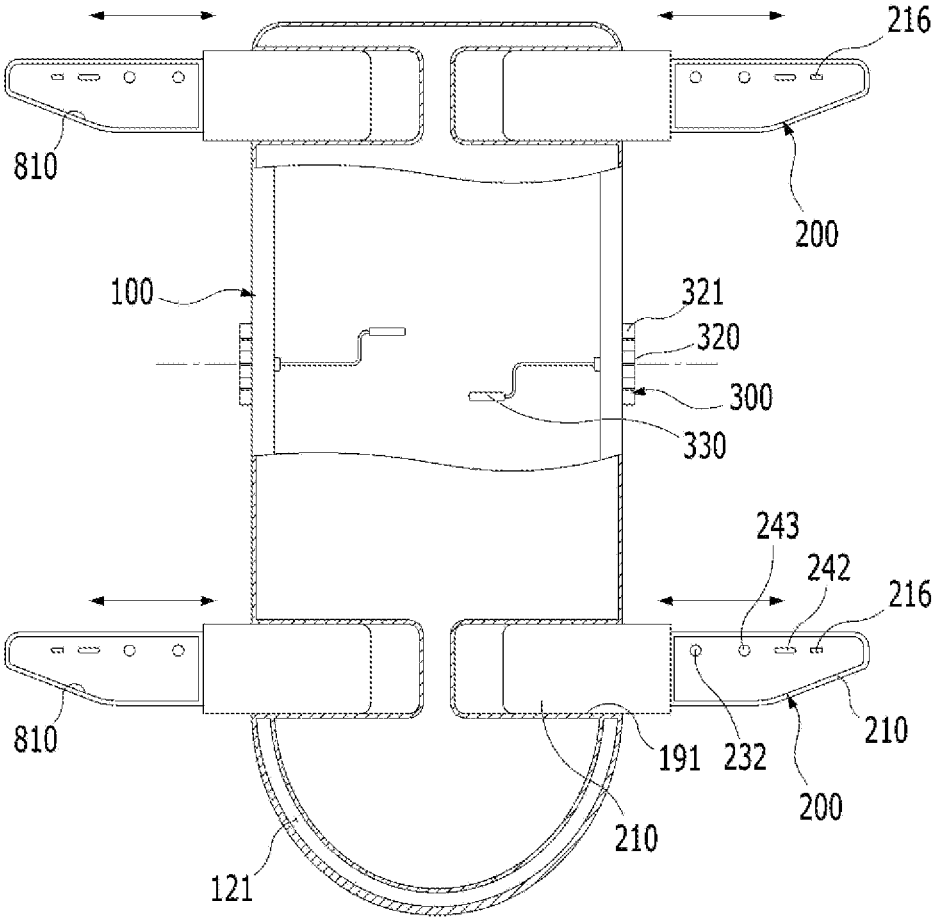
FIG. 14 is a top cross sectional view illustrating a state in which the buoyant wing part of the winged boat is applied in such a way that the length of the buoyant wing part is adjustable according to the present invention.
Figure 15:
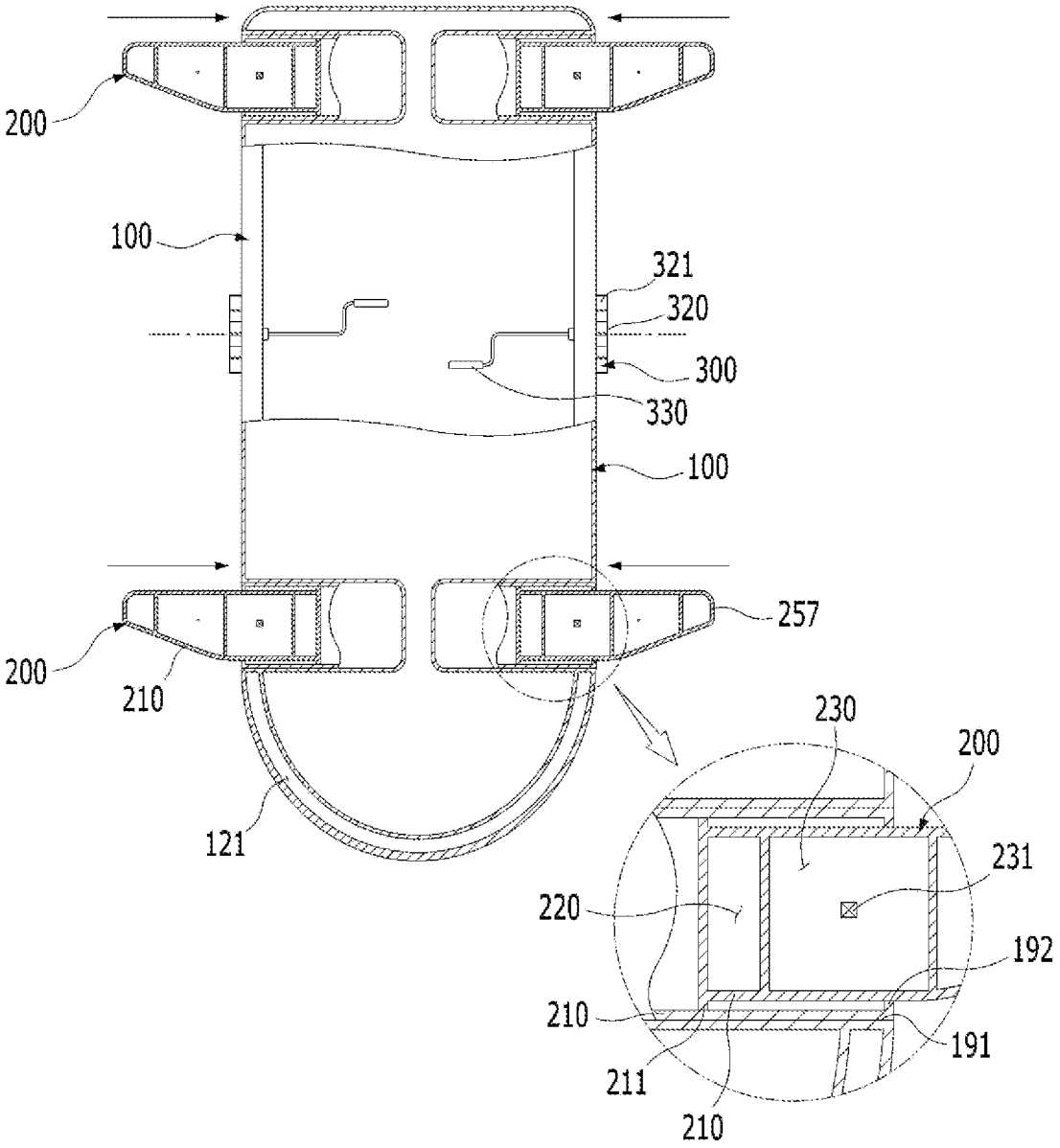
FIG. 15 is a top cross sectional view illustrating an inner structure of the buoyant wing part of the winged boat that is applied in such a way that the length of the buoyant wing part is adjustable according to the present invention.
Figure 16A:
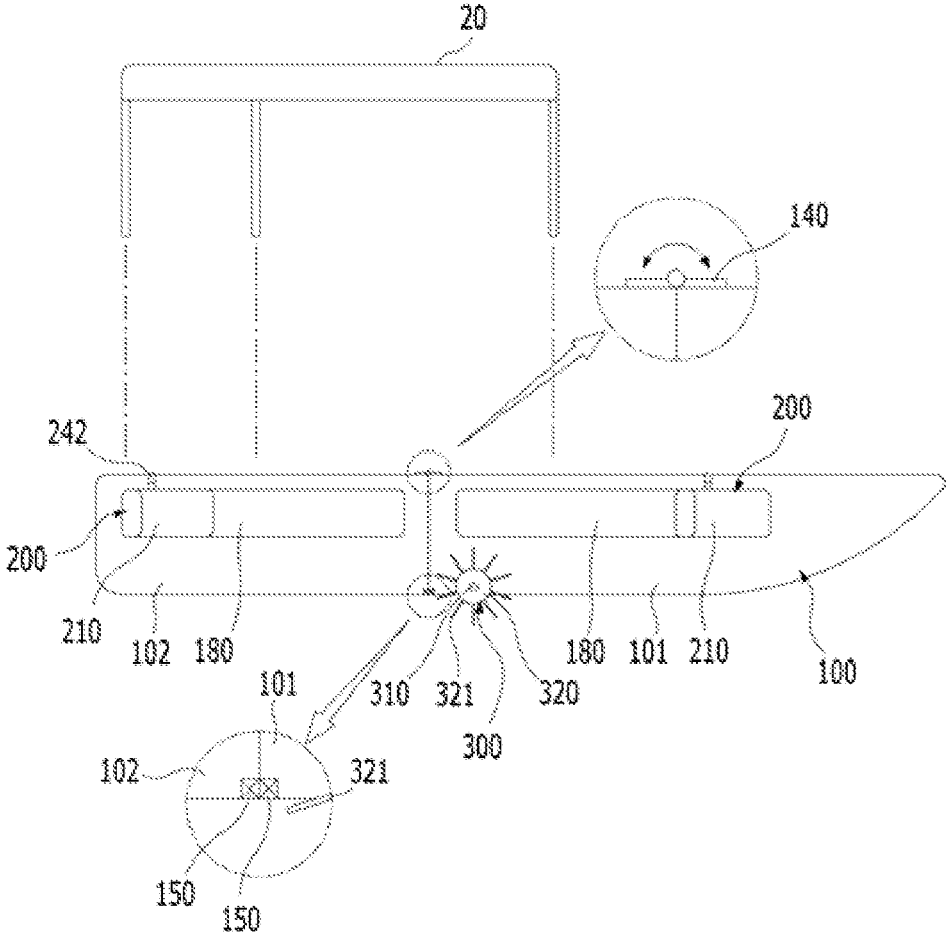
FIGS. 16A and 16B are side view illustrating a state in which a main body of the winged boat is applied to be foldable according to the present invention.
Figure 16B:
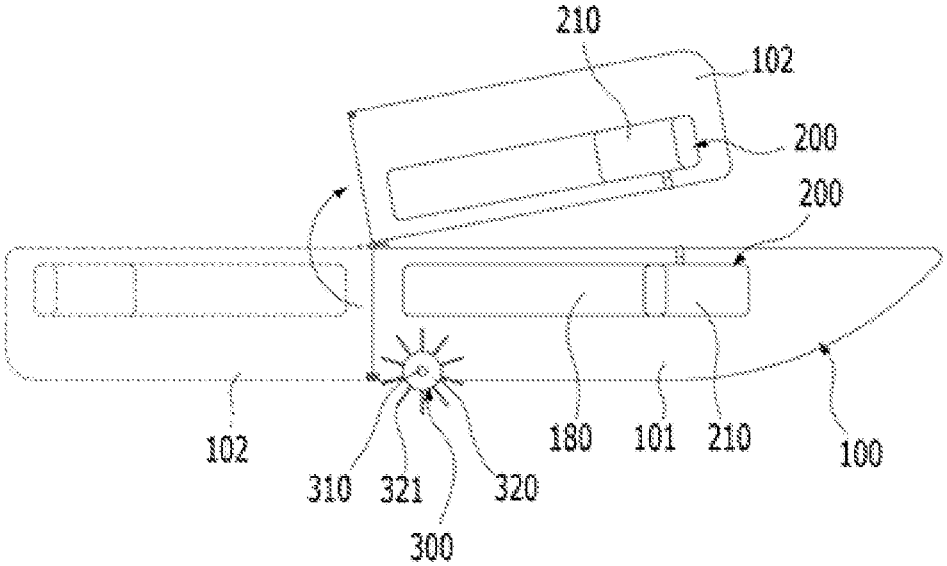
Figure 17:
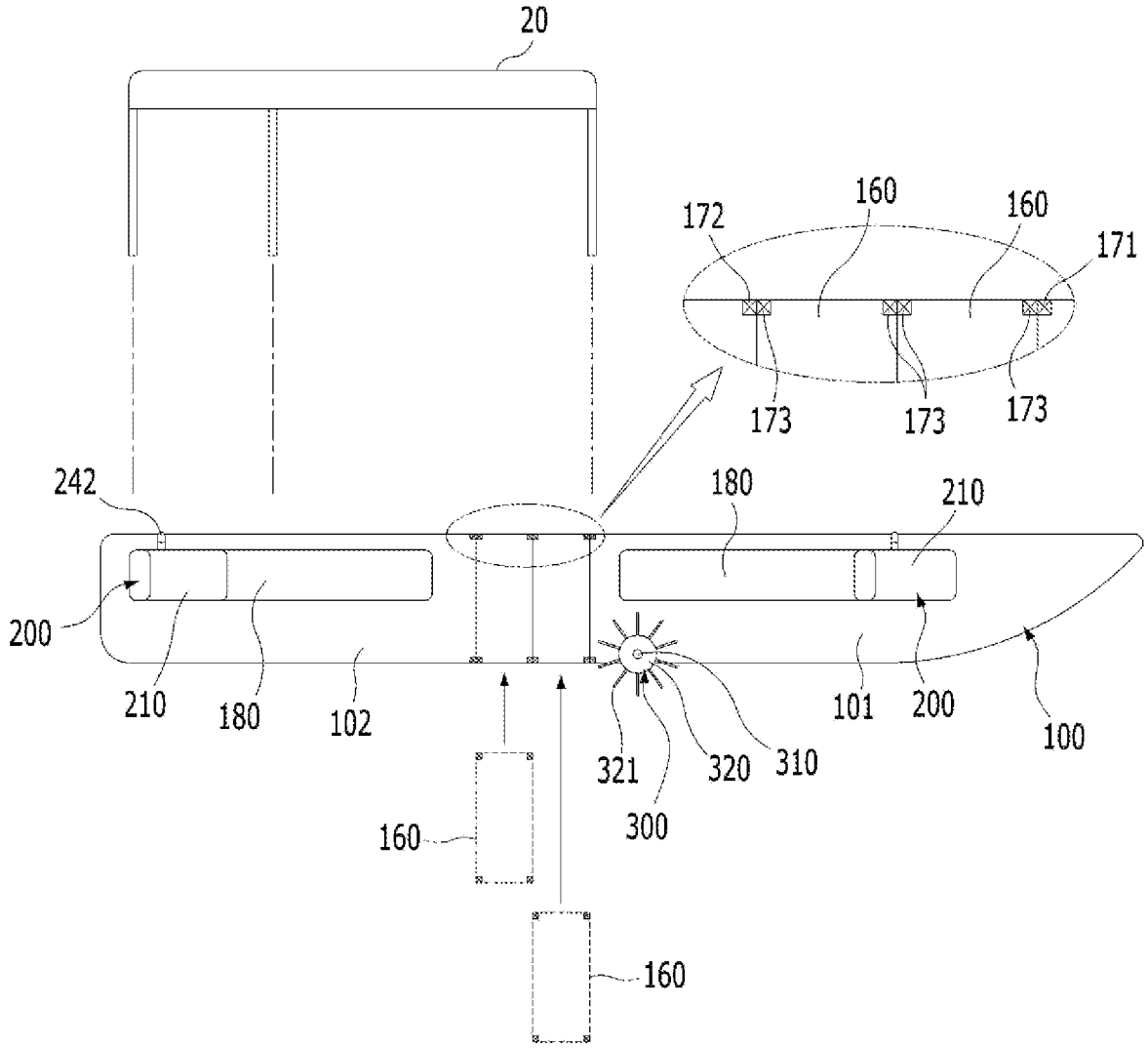
FIG. 17 is a side view illustrating a state in which a connecting block is applied to a main body of the winged part according to the present invention.
Figure 18:
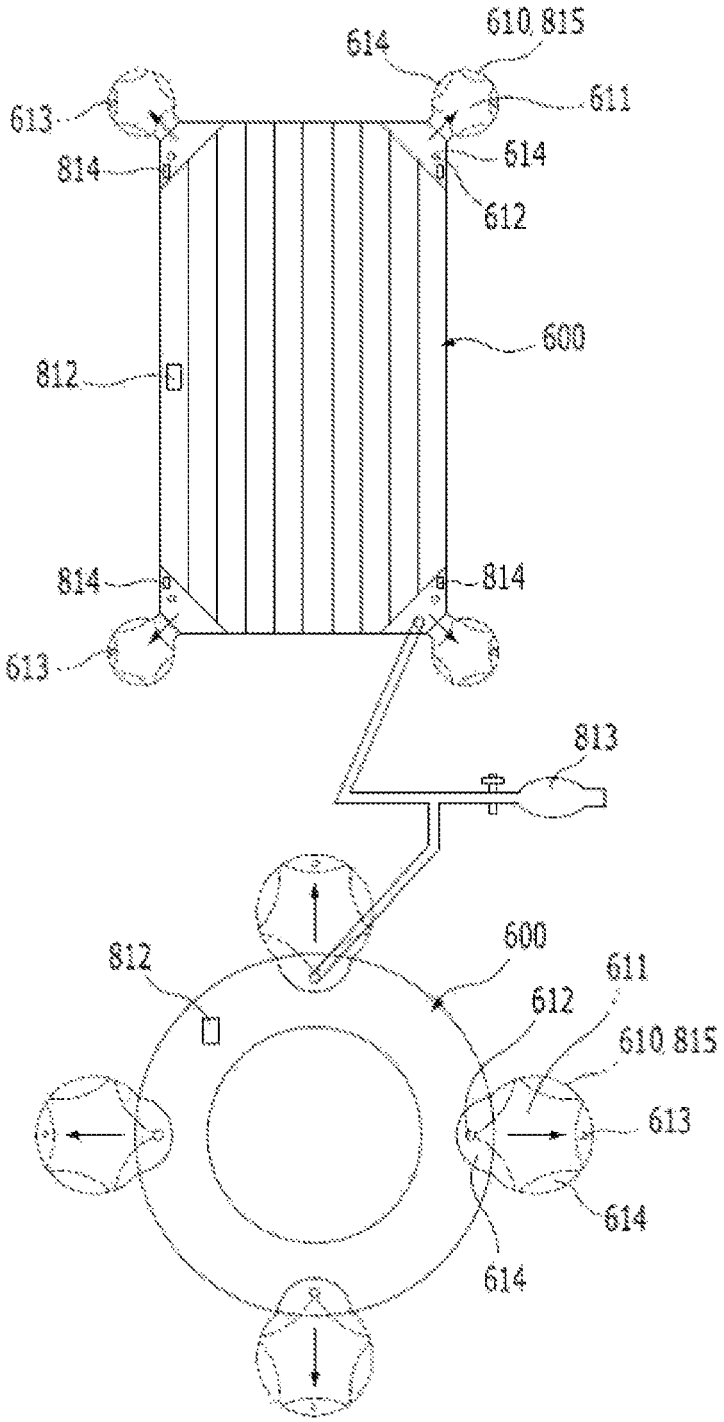
FIG. 18 is a top view illustrating a water play tube of a winged part according to the present invention.
Figure 19:
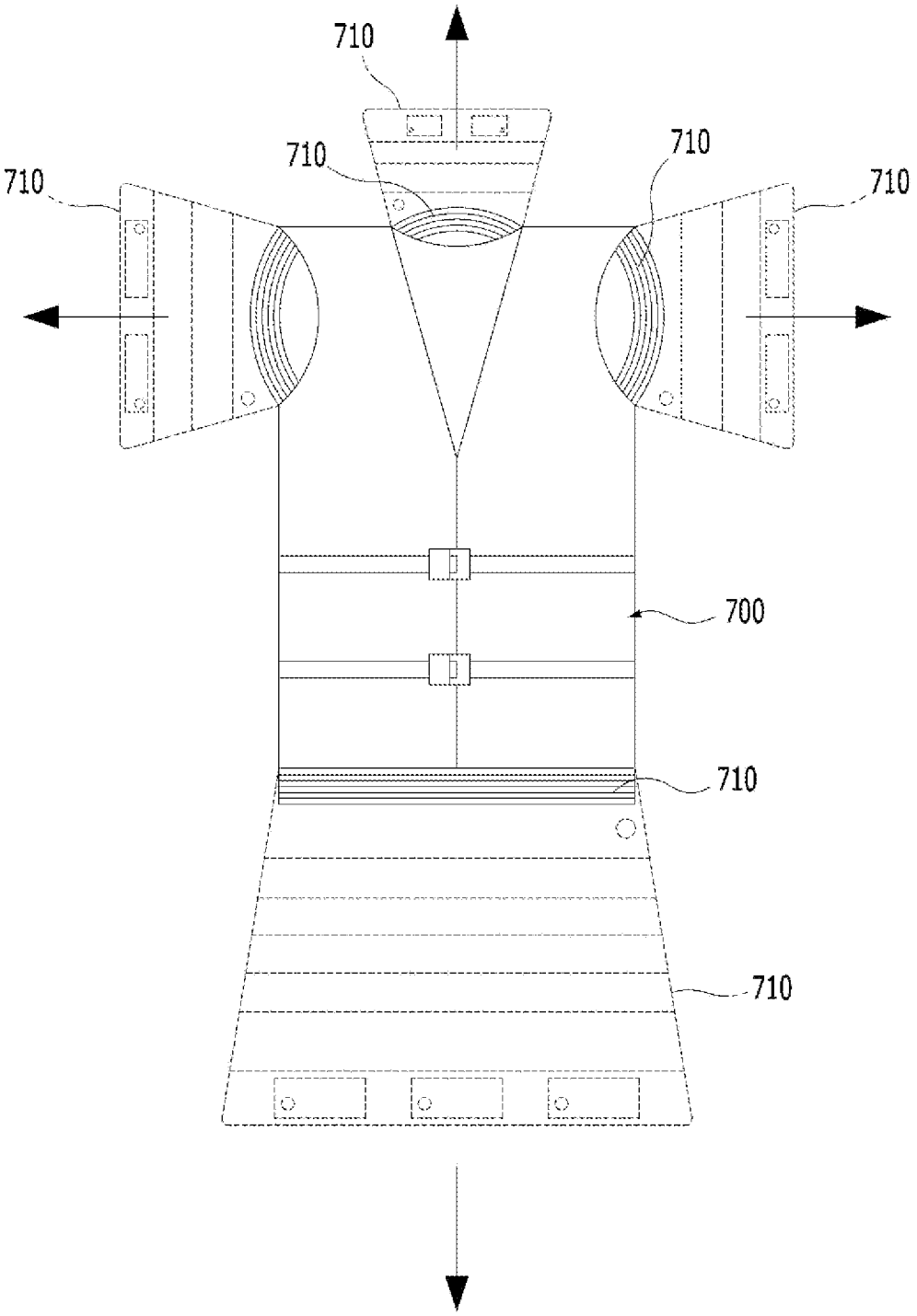
FIG. 19 is a front view illustrating a life jacket of a winged part according to the present invention.
Figure 20:
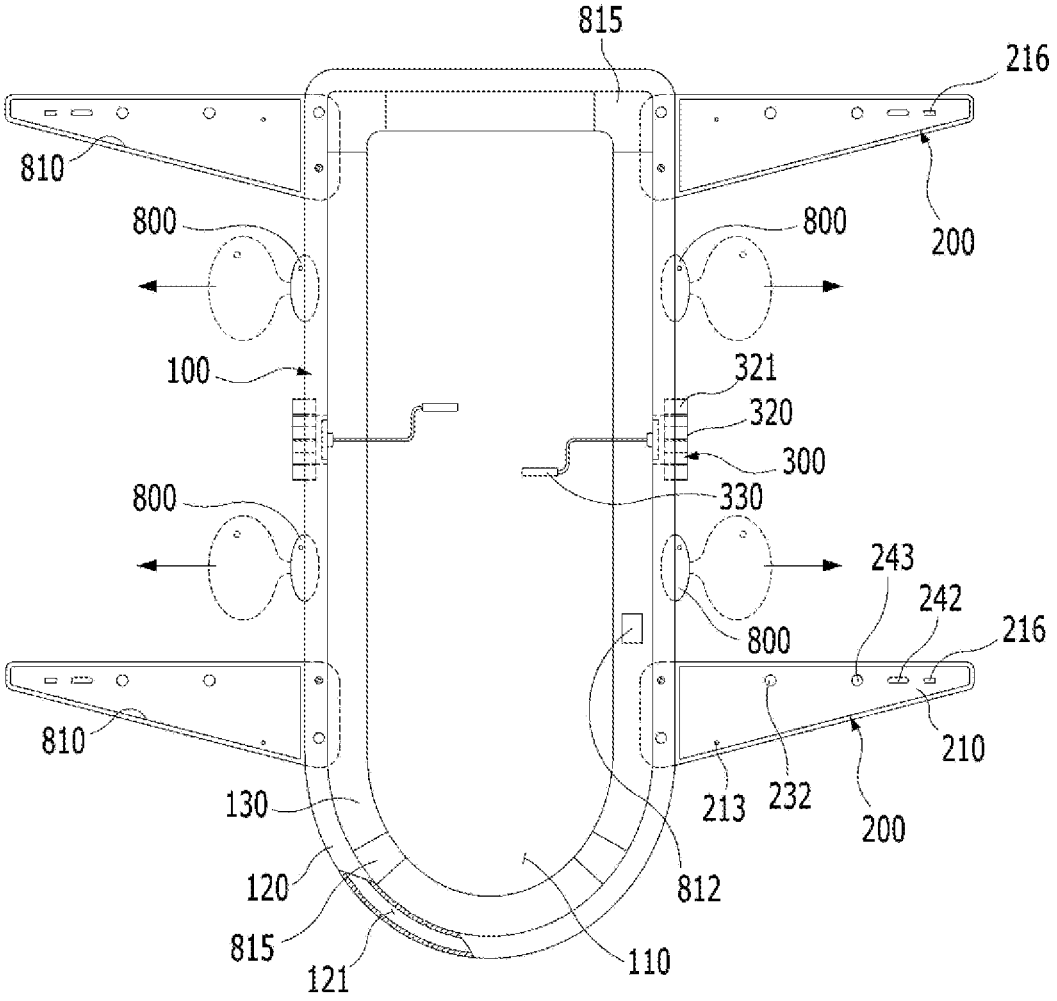
FIG. 20 is a front view illustrating an auxiliary buoyancy control part of a winged part according to the present invention.

FIG. 13 is a top view illustrating a state in which the buoyant wing part of the winged boat is applied in such a way that the length of the buoyant wing part is adjustable according to the present invention. FIG. 14 is a top cross sectional view illustrating a state in which the buoyant wing part of the winged boat is applied in such a way that the length of the buoyant wing part is adjustable according to the present invention. FIG. 15 is a top cross sectional view illustrating an inner structure of the buoyant wing part of the winged boat that is applied in such a way that the length of the buoyant wing part is adjustable according to the present invention. FIGS. 16A and 16B are side view illustrating a state in which a main body of the winged boat is applied to be foldable according to the present invention. FIG. 17 is a side view illustrating a state in which a connecting block is applied to a main body of the winged part according to the present invention. FIG. 18 is a top view illustrating a water play tube of a winged part according to the present invention. FIG. 19 is a front view illustrating a life jacket of a winged part according to the present invention. FIG. 20 is a front view illustrating an auxiliary buoyancy control part of a winged part according to the present invention.

FIGS. 1 to 20, the winged boat according to the present invention comprises a main body 100, buoyant wing part 200, and a propulsive force generating part 300.

The main body 100 is made of a buoyant material to be able to float on the water surface 10. A passenger space 110 is concavely formed on an upper portion of the main body 100 so that a passenger can be accommodated therein, and a handrail 120 with a certain height may be provided at the edge of the passenger space 110.

In addition, a seat 130 on which the passenger can be seated may be provided along an inner circumference of the handrail 120. The handrail 120 may include a closed space 121 inside to form buoyancy so that the main body 100 does not sink under the water. Here, the handrail 120 may be continuously formed along the edge of the main body 100, and the closed space 121 may be partially or continuously formed inside the handrail 120 along the edge of the main body 100. In this case, a filler such as Styrofoam for forming buoyancy may be inserted inside the closed space 121.

The closed space 121 is formed at the edge of the main body 100, and since the closed space 121 is kept filled with air, the main body 100 can be prevented from capsizing in an instant. Referring to past ship accidents, a ship capsized in 7 seconds on the Danube River in Hungary and 26 Koreans killed in this accident, and a ship capsized in 2 minutes on the Yangtze River, killing 420 people.

A roof structure 20 may be coupled to and separated from the upper portion of the main body 100. The roof structure 20 may be provided with a cover for covering the upper portion of the passenger space 110 and a support for supporting the cover from the lower portion thereof. In this case, a plurality of installation parts (not shown) for coupling to the support of the roof structure 20 may be provided on the upper portion of the main body 100, and a coupling hole may be formed on the upper portion of the installation part to insert the support of the roof structure 20. The roof structure 20 may be coupled to or separated from the installation part.

In addition, a seat belt storage box 812 may be provided in the passenger space 110. The seat belt storage box 812 can accommodate a seat belt (not shown) therein, and a door can be provided at the upper portion of the seat belt storage box 812 to open and close the seat belt storage box 812. The seat belt can be withdrawn to the outside in a state in which the door is open.

For example, if the passenger falls overboard and is separated from the boat due to sudden waves or strong wind, seat belts are required to prevent a life threatening accident. If the passenger is wearing a seat belt on his or her wrist or waist, the passenger is connected to the boat, and safety can be ensured even if the passenger suddenly falls off the boat.

In addition, in case of a person using a water tube, if the tube is flipped in the deep water that is deeper than his or her height, they may panic and faint from exhaustion if the tube is repeatedly flipped while they struggle to reenter to the tube. However, if they wear a life safety belt on your wrist or waist or uses a water play equipment equipped with a buoyant body, the risk can be prevented.

As shown in FIGS. 16A and 16B, a winged boat according to an embodiment of the present invention may include: a front body 101 positioned in a front portion; a rear body 102 positioned in a rear portion; a hinge portion 140 that rotatably connects the upper end of the rear of the front body 101 to the upper end of the front of the rear body 102 and that forms a horizontal rotation center in the left and right direction, and a pair of locking members 150 one of which is provided at the lower end of the rear of the front body 101 and the other of which is provided at the lower end of the front of the rear body 102 so that the locking members 150 are coupled and separated from each other.

Meanwhile, if a portable boat can be accommodated in a car, the boat can be easily carried even through a natural trail without a roadway. Thus, it is desired that the size of the boat carried in a car is about 90 cm in width and about 180 cm in length, which is the size of Styrofoam, the length of the wing is about 75 cm, the body is about 13 kg, and the four wings are about 8 kg. The boat according to the present invention can be accommodated in the remaining space of a 7-seater car with two passengers. Accordingly, people can enjoy water leisure with this boat without being restricted by location.

A pair of locking members 150 may be selectively applied with a structure comprising two components that can be connected to and detached from each other by a user. In a separated state of the locking members 150, the front body 101 and the rear body 102 may rotate in a folded direction. In addition, the locking member 150 may be coupled to each other and keep the front body 101 and the rear body 102 in an unfolded state in the front and rear direction. The locking member 150 may selectively use various structures as needed.

For example, by separating the locking members 150 from each other, the rear body 102 may be positioned on the upper portion of the front body 101 in a folded state. In this case, since the volume of the main body 100 reduces, the boat can be easily loaded and transported in a vehicle and can be conveniently stored when not in use.

In addition, as shown in FIG. 17, the winged boat according to an embodiment of the present invention may include: a front body 101 positioned in the front portion of the main body 100; the rear body 102 positioned in the rear portion of the main body 100; at least one connecting block 160 coupled between the front body 101 and the rear body 102; at least one first fastening member 171 provided at the rear end of the front body 101; at least one second fastening member 172 provided at the front end of the rear body 10, and a third fastening member 173 provided at the front and rear ends of the connecting block 160 to be coupled to and separated from the first fastening member 171 and the second fastening member 172

For example, in order to increase the length of the main body 100, one or more connecting blocks 160 may be positioned between the front body 101 and the rear body 102. The third fastening member 173 positioned at the front end of the connecting block 160 and the first fastening member 171 positioned at the front body 101 may be coupled, and the third fastening member 173 positioned at the rear end of the connecting block 160 and the second fastening member 172 positioned at the rear body 102 may be coupled. The first fastening member 171, the second fastening member 172, and the third fastening member 173 may selectively use various structures as needed.

In addition, when a plurality of connecting blocks 160 are applied by coupling the third fastening members 190 of the connecting blocks 160 to each other, the length of the main body 100 can increase. That is, the length of the main body 100 can increase by the length in the front and rear direction of the connecting block 160. In addition, by separating the connecting block 160 or adjusting the number of the connecting block 160, the length of the main body 100 can be adjusted.

The buoyant wing part 200 is provided to prevent the main body 100 from tilting or capsizing. The buoyant wing part 200 protrudes from both sides of the main body 100 and is made of a buoyant material to float on the water surface 10. Here, a pair of buoyant wing parts 200 may be disposed in a front area of the main body 100, and the other pair of buoyant wing parts 200 may be disposed in a rear area of the main body 100.

The buoyant wing part 200 according to an embodiment of the present invention includes: a wing body 210 protruded from the side of the main body 100 with a certain length; a buoyant space 220 formed inside the wing body 210 in a closed state; a water storage part 230 disposed in an opposite direction to the main body 100 with respect to the buoyant space 220 and having an opening and closing part 231 operably provided at the lower portion thereof and an inlet 232 formed at the upper portion thereof, and buoyancy control part 240 provided in the opposite direction to the buoyant space 220 with respect to the water storage part 230 and adjusting buoyancy of the wing body 210 by controlling an amount of water W stored therein. In addition, the buoyant wing part 200 may further include a stopper 233 that is provided on an upper portion of the inlet 232 in a combinable and detachable way.

The wing body 210 may protrude perpendicular to the front and rear direction of the main body 100 but is not limited thereto. In another embodiment, the body 210 may protrude to be inclined backward. A front side of the wing body 210 may be inclined backward in order to reduce frictional resistance generated when the boat advances.

Here, on a top surface of the body 210, a water tray groove 810 may be concavely formed so that water can be introduced through an upper portion of the inlet 232 and a water entrance 243. For example, when the main body 100 floats on the water surface, water may be introduced into the water tray groove 810, and the water introduced into the water tray groove 810 can be automatically entered into the inlet 232 and the water entrance 243.

The buoyant space 220 is a space filled with air and is kept in a closed state. That is, since the buoyant space 220 is kept in a state being filled with air therein, the wing body 210 can be prevented from sinking under the water and thus the boat does not easily capsize.

The water storage part 230 is for adjusting buoyancy of the wing body 210. Water W may be supplied to the inside of the water storage part 230 through the inlet 232, and water W stored inside the water storage part 230 can be discharged downward through the opening and closing part 231. By adjusting the capacity of the water W stored in the water storage part 230, the wing body 210 can be adjusted not to rise or sink excessively.

The inlet 232 is configured to supply water W into the water storage part 230 and may be vertically open toward the upper portion of the wing body 210. The inlet 232 may have a tapered shape so that the diameter of the inlet 232 gradually increases as it goes toward the top. The opening and closing part 231 may have a structure such as a valve that can be operated by a user.

The stopper 233 can seal the water storage part 230 when coupled to the inlet 232 and can open the water storage part 230 upward when separated from the inlet 232. For example, when the stopper 233 is removed and water is supplied into the water storage part 230 through the inlet 232, the weight of the wing body 210 increases and thus the buoyant wing part 200 can be prevented from rising to the water surface. Meanwhile, when the opening and closing part 231 is open to discharge the water of the water storage part 230 to the outside, and then the stopper 233 is coupled to the inlet 232, the wing body 210 has buoyancy, and thus, the buoyant wing part 200 can be prevented from sinking under the water surface.

In addition, the upper portion of the wing body 210 may be further provided with a buoyant body connecting ring 814 for coupling a substitute buoyant body. A plurality of water-air boxes 815 capable of selectively injecting and discharging water and air may be provided in the passenger space 110. Here, the water-air boxes 815 may be provided inside the seat 130. In addition, the water-air box 815 may include an inlet for injecting and discharging water and air. The inlet is communicated to the outside and may be open and close by a stopper or the like.

The buoyancy control part 240 is for adjusting the buoyancy of the wing body 210 and can control the amount of water W stored therein by a user's manipulation. The buoyancy control part 240 according to an embodiment of the present invention may include: a storage space 241 formed in an opposite direction to the buoyant space 220 with respect to the water storage part 230; an air passage 242 extending from the storage space 241, exposed to the upper portion of the wing body 210, and communicating between the storage space 241 and the outside of the body 210; a water entrance 243 vertically penetrating the upper portion of the storage space 241; an lifting member 244 provided in the inside of the storage space 241 in an elevatable way, discharging water W stored in the storage space 241 through the water entrance 243 when ascending, and discharging air in the storage space 241 to the outside through the air passage 242 when descending; a control member 245 provided in the main body 100 to be rotatably operable, and a connecting cable 246 having one longitudinal end connected to a top end of the lifting member 244 and the other end wound around an outer side of the control member 245.

The air passage 242 is for discharging the air of the storage space 241 to the outside or for introducing external air into the storage space 241. A bottom end of the air passage 242 may be vertically inserted through the upper portion of the wing body 210 and connected to one side of the storage space 241, and a top end of the air passage 242 may protrude vertically from the upper portion of the wing body 210. In this case, the top end of the air passage 242 may be bent downward, and an inlet formed at the top end of the air passage 242 may face downward so that foreign substances or the like are not introduced.

The water entrance 243 is configured for discharging water W stored in the storage space 241 to the outside or supplying water W from the outside to the storage space 241. The water entrance 243 may have a tapered shape so that a diameter of the water entrance 243 gradually increases as it goes toward the upper portion.

The lifting member 244 may be positioned horizontally in the storage space 241, and a side surface of the lifting member 244 has a shape corresponding to a side surface of the storage space 241 and is in close contact with the side surface of the storage space 241. Here, a connecting ring for connecting a connecting cable 246 may be provided at a top end of the lifting member 244. When the lifting member 244 descends, the bottom end of the air passage 242 may be connected to one side of the storage space 241 at a height lower than the bottom end of the lifting member 244.

For example, as shown in FIG. 7, when the lifting member 244 ascends, the water W stored in the storage space 241 is discharged to the outside through the water entrance 243, and external air of the wing body 210 is supplied to the inside of the storage space 241 through the air passage 242. Accordingly, since buoyancy of the storage space 241 increases, the wing body 210 can be prevented from sinking under the water.

On the other hand, as shown in FIG. 6, when the lifting member 244 descends, air stored in the storage space 241 is discharged to the outside through the air passage 242 by the weight of the lifting member 244, and a space through which water W can be introduced is formed above the lifting member 244. When water W is introduced onto the upper portion of the lifting member 244, buoyancy of the storage space 241 reduces, and the wing body 210 can be prevented from rising above the water surface 10.

The plurality of control members 245 may be rotatably installed on the upper portion of the wing body 100. A handle that can be gripped by a user's hand may be installed on the control member 245, and the connecting cable 246 may be wound on the outer side of the control member 245. For example, when the user rotates the control member 245 in a water discharging direction, the lifting member 244 ascends, and when the user rotates the control member 245 in a water supplying direction, the lifting member 244 descends.

In addition, a plurality of control members 245 may rotate in both directions by a rotational force of a driving part 256 such as a motor. A driving shaft of the driving part 256 may be mechanically connected to a rotation center of the control member 245 to transmit the rotational force, and a manipulation part (not shown) may be electrically connected to the driving part 256 so that the user can control operation.

In addition, a control part 400 may be further electrically connected to the driving part 256. In this case, an angle sensing part 500 may be further electrically connected to the control part 400, and the angle sensing part 500 includes a gyro sensor and other similar devices to detect whether the main body 100 is kept in a horizontal state. For example, when the main body 100 tilts in one direction, the angle sensing part 500 transmits an inclination detection signal of the main body 100 to the control part 400, and the control part 400 controls the driving parts 256.

The connecting cable 246 transmits a traction force to the lifting member 244 when the user rotates the control member 245 in the water discharging direction. When the user rotates the control member 245 in the water supplying direction, since the traction force of the connecting cable 246 is released, the lifting member 244 can descend by its own weight. Here, one longitudinal end of the connecting cable 246 may be inserted into the storage space 241 through the inside of the wing body 210.

Here, a passage for connecting the connecting cable 246 to the inside of the main body 100 may be formed in the upper portion of the storage space 241, and a support roller for supporting the lower portion of the connecting cable 246 may be provided in the lower portion of the passage. The support roller is rotatably installed on the horizontal rotation center provided at the lower portion of the passage. The lower portion of the connecting cable 246 is supported by the upper portion of the support roller, and thus, the connecting cable 246 can maintain tension. When the connecting cable 246 moves in both directions, the support roller engages and rotates along with the connecting cable 246 and can support the connecting cable 246 while rotating.

Meanwhile, as shown in FIG. 9, the buoyancy control part 240 according to an embodiment of the present invention is formed in the opposite direction to the buoyant space 220 with respect to the water storage part 230 and may include: an installation groove 251 a lower portion of which is vertically open downward; a tube 252 having a top end coupled to a top end of the installation groove 251, capable of being expandable and contractible in the vertical direction, and having an accommodating space inside; a water entrance 253 penetrating vertically through the upper portion of the tube 252; a plurality of air pumps 254 provided in the main body 100 and sucking or discharging air; a connecting pipe 255 having one longitudinal end connected to the top end of the tube 252 and the other end being opposite to the longitudinal end of the connecting pipe 255 and connected to the air pump 254.

The tube 252 can be manufactured using an elastic material such as rubber so that the length of the tube 252 can be extended downward when air is supplied to the inside, and when air inside the tube 252 is discharged to the outside, the length can reduce upward. In this case, a wrinkle portion may be formed on an outer surface of the tube 252 and be folded or unfolded in the vertical direction. The wrinkle portion may have a length along a lateral direction of the tube 252, and a plurality of wrinkles may be arranged along the vertical direction. For example, when the volume of the tube 252 increases, buoyancy of the tube 252 increases, and thus, the wing body 210 can be prevented from sinking under the water. On the other hand, when the volume of the tube 252 reduces, buoyancy of the tube 252 reduces, and thus, the wing body 210 can be prevented from rising above the water surface 10.

In addition, a wire (not shown) may be connected to the tube 252. One longitudinal end of the wire is coupled to an outside of the tube 252, and the other end opposite to the longitudinal end can be extended to a location where the user can manipulate through the inside of the body 210. Here, the longitudinal end of the wire may be exposed to the passenger space 110 so that the user can hold it by hand.

The water entrance 253 is configured for discharging water W stored in the tube 252 to the outside or supplying water W from the outside to the tube 252. The water entrance 243 may have a tapered shape so that a diameter of the water entrance 243 gradually increases as it goes toward the top.

For example, when water is injected into the inside of the tube 252 through the water inlet 253, the length of the tube 252 is extended downward, and the buoyant wing part 200 can be prevented from rising to the water surface by the weight of water filled in the tube 252. On the other hand, when the user pulls the longitudinal end of the wire and discharges water filled in the tube 252 to the outside through the water inlet 253, the wing body 210 has buoyancy, and thus, the buoyant wing part 200 can be prevented from sinking under the water surface.

A plurality of air pumps 254 may be installed on the upper portion of the main body 100, and the control part may be electrically connected so that the user can control the operation. For example, when the user operates the air pump 254 in an air discharging mode, internal air of the tube 252 moves through a connecting pipe 255 and then discharged to the outside through the air pump 254. In addition, when the user operates the air pump 254 in an air injecting mode, external air is injected into the tube 252 through the connecting pipe 255.

Thus, when the air pump 254 is operated in the air discharging mode, the connecting pipe 255 moves air stored in the tube 252 to the air pump 254. In addition, when the air pump 254 is operated in the air injecting mode, the connecting pipe 255 moves external air to the air pump 254. Here, one longitudinal end of the connecting pipe 255 may be inserted into the top end of the tube 252 through the inside of the wing body 210.

In addition, the control part 400 may be further electrically connected to the air pumps 254. In this case, the angle sensing part 500 may be further electrically connected to the control part 400, and the angle sensing part 500 includes a gyro sensor and other similar devices to detect whether the main body 100 is kept in a horizontal state. For example, when the main body 100 tilts in one direction, the angle sensing part 500 transmits an inclination detection signal of the main body 100 to the control part 400, and the control part 400 controls the air pumps 254.

In addition, a buffer member 257 having a buffer space formed inside may be provided at a protruding end of the buoyant wing part 200. The buffer space may be formed inside the buffer member 257 in a closed state. The buffer member 257 may be made of an elastic material such as rubber so that it can be restored to its original shape by its own elastic force after elastic deformation.

In addition, the boat may further include buoyancy body connecting ring 814 provided at the outer side of the buoyant wing part 200 for coupling a substitute buoyant body and an auxiliary opening and closing part (not shown) that can open and close at one side of the buffer member 257. The buffer member 257 can inject water to the inside or discharge water to the outside by opening and closing the auxiliary opening and closing part. One side of the buffer member 257 communicates with the tube 252 so that water flows into the buffer space or is discharged to the tube 252. That is, since the buffer member 257 cushions an external impact, the main body 100 can be prevented from being damaged by an impact of the surrounding structures and from capsizing or sinking. In addition, a volume of the boat can be adjusted and can prevent collision accidents.

As shown in FIGS. 1 to 9, the winged boat according to an embodiment of the present invention may further comprise a mounting groove 180 concavely formed on both sides of the main body 100 and having a length in a front and rear direction. One longitudinal end of the wing body 210 is rotatably coupled to a vertical rotation center formed in a front or a rear portion of the mounting groove 180, and when the wing body 210 rotates toward a longitudinal direction of the main body 100, a width directional portion of the wing body 210 is inserted into the mounting groove 180.

Here, a first fastening hole 213 may be vertically formed at the top end of the wing body 210, and a second fastening hole 214 may be vertically penetrated through the top end of the handrail 120 described above. In addition, a fastening pin 215 can fix the wing body 210 being in an inserted state into the mounting groove 180 by vertically penetrating a lower portion of the fastening pin 215 through the second fastening hole 214 and the first fastening hole 213. Meanwhile, by separating the fastening pin 215 from the upper portion of the second fastening hole 214, the wing body 210 can be spread on both sides of the main body 100.

For example, in a state in which the boat is anchored, the body 210 of the buoyant wing part 200 is adjusted to rotate toward the outside of the main body 100 to form a projecting structure. On the other hand, in a state in which the boat is in operation, the wing body 210 of the buoyant wing part 200 is adjusted to rotate toward the inside of the main body 100 to form a structure where the wing body 210 is inserted into the mounting groove 180. In this case, since the volume of the wing body 210 reduces, resistance generated when the boat moves can also reduce. In addition, since the volume of the boat can reduce, the boat can be easily stored and transported.

In addition, as shown in FIGS. 10 to 15, the winged boat according to an embodiment of the present invention may further comprise: an insertion groove 191 concavely formed on both sides of the main body 100 and a locking shoulder 192 protruding from an inner circumferential surface of the insertion groove 191. One longitudinal end of the wing body 210 is slidably inserted into the insertion groove 191 and has a locking protrusion 211 protruding in its width direction. When the wing body 210 is slidingly withdrawn from the insertion groove 191, the locking protrusion 211 is hooked on the locking shoulder 192, and thus, a withdrawn length of the body 210 can be limited.

Here, a guide groove that is open toward a direction opposite to the main body 100 may be formed inside the wing body 210, and another wing body 210 capable of retracting in a sliding manner may be correspondingly inserted into the guide groove. For example, when the wing body 210 is inserted into the guide groove, the length of the wing body 210 reduces, and when the wing body 210 is withdrawn from the guide groove, the length of the wing body 210 increases. That is, when the length of the wing body 210 reduces, resistance generated during the operation of the boat can reduce. In addition, the volume of the boat can reduce, the boat can be easily stored and transported.

A propulsive force generating part 300 is configured to move the boat forward and backward or to adjust a driving direction. The propulsive force generating part 300 may include: a pair of rotating shafts 310 forming horizontal rotation centers on both sides of the main body 100 in a left and a right direction; a pair of rotating blades parts 320 rotatably installed on the rotating shafts 310, and a pair of rotating levers 330 provided on both sides of the passenger space 110 to be rotatably operable, respectively, and mechanically connected to the rotating shaft 310.

Each of the rotating shafts 310 may have one axial end protruding in a left or a right direction of the main body 100, and a rotating blade part 320 may rotate forward or backward with respect to the rotating shaft 310. A plurality of blades 321 for generating the propulsive force during rotation may be arranged at regular intervals on an outer circumferential surface of the rotating blade part 320.

The rotating lever 330 may have one longitudinal end rotatably inserted into a left and a right wall surface of the passenger space 110. In this case, the rotating lever 330 may be mechanically connected to one axial end of the rotating shaft 310 by a power transmission member such as gears, and the other end opposite to the axial end has an eccentrically bent shape that can be rotated in a state held by the user. In addition, one longitudinal end of the rotating lever 330 may have a structure that allows the user to rotate the rotating lever 330 in a state of holding it by the hand or while stepping on it with a foot. For example, one end of the rotating lever 330 may be provided with a handle so that the user can grip it by the hand.

For example, when the user rotates forward while holding one end of the rotating lever 330, the rotating blade part 320 rotates and generates a propulsive force, and the main body 100 moves forward by a propulsive force of the rotating blade part 320. On the other hand, when the user rotates backward while holding one end of the rotating lever 330, the rotating blade part 320 rotates and generates a propulsive force, and the main body 100 moves backward by a propulsive force of the rotating blade part 320

In addition, when the user rotates only the left side rotation lever 330 forward, a propulsive force is generated only on the left side of the main body 100, and thus, the main body 100 rotates to the right. On the other hand, when the user rotates only the right side rotation lever 330 forward, a propulsive force is generated only on the right side of the main body 100, and thus, the main body 100 rotates to the left.

Meanwhile, although not shown, the propulsive force generating part 300 may be installed inside the wing body 210. In this case, a portion of the wing body 210 is formed with an installation space that is open downward. A rotating shaft 310 may be installed in the installation space, and a rotating blade part 320 may be installed to be rotatable on the rotating shaft 310 of the installation space. At this time, a bottom end of the rotating blade part 320 may be positioned in a state inserted into the water, and when the user rotates the rotation lever 330, the rotating blade part 320 generates a propulsive force in a state located under the wing body 210 and being contact with water W.

In some embodiments, a pair of rotation driving parts (not shown) for transmitting a rotational force to the rotation shaft 310 may be further provided on both sides of the main body 100. The rotation driving part may use a motor or the like. A driving shaft of the rotating driving part may be mechanically connected to the rotating shaft 310 and electrically connected to the control part 400 to control the operation thereof. For example, the user may control an ON/OFF state and a rotation direction of the rotation driving part by using the control part 400 and selectively operates one of the pair of rotation driving parts to adjust a driving direction of the main body 100.

As shown in FIG. 18, the winged boat according to an embodiment of the present invention may comprise a first buoyancy air box 610 provided at a water play tube 600 where air is injected and at an edge of the water play tube 600 and made of an elastic material such as rubber to be stretchable.

The first buoyancy air box 610 of the water play tube 600 is provided with a water entrance 613 to be open and close for selectively injecting water W or air, and a water storage part 614 is formed inside the first buoyancy air box 610 so that water can be stored. Since buoyancy of the first buoyancy air box 610 can be controlled, the water play tube 600 does not easily tilt or overturn.

Here, a stretchable air balloon 611 may be provided inside the first buoyancy air box 610, and an air passage 612 for injecting air into the air balloon 611 or discharging air filled in the air balloon 611 to the outside may be provided at one side of the first buoyancy air box 610. In addition, buoyancy body connecting ring 814 for coupling a substitute buoyant body may be further provided in the outer side of the first buoyancy air box 610.

In addition, a pressurized pumping device 813 for pumping air may be connected to the air passage 612. The pressurized pumping device 813 may be provided with a connecting pipe having one longitudinal end connected to the air passage 612 and a pump connected to the connecting pipe for operating pumping. The pressure pumping device 813 may introduce air into the air passage 612 through a pressing operation of the pump.

That is, if an air rubber tube, which is a water play equipment, is flipped in the deep water that is deeper than a person's height, they may panic and faint from exhaustion if the tube is repeatedly flipped while they struggle to reenter to the tube. However, if a user wears a life safety belt around your wrist or waist and uses a water play equipment, which buoyant bodies are attached to, the risk can be prevented.

Meanwhile, as shown in FIG. 19, the winged boat according to an embodiment of the present invention may include: a life jacket 700 that has buoyancy and can be worn on the user's upper body and a second buoyancy air box 710 made of an elastic material such as rubber to be stretchable.

A second buoyancy air box 710 of the life jacket 700 is provided in such a way that an inlet and an outlet can be open and close for selectively injecting water W or air. In addition, the second buoyancy air box 710 may be provided in a lower end of the life jacket 700 through which the user's waist passes, in both sides of the life jacket 700 through which the user's arm passes, and in an upper end of the life jacket 700 through which the user's neck passes. The number and position of the second buoyancy air box 710 can be variously applied as needed.

That is, in order to prevent fainting by waves or strong winds in the sea, it is safe to wear the life jacket 700. In addition, an existing life jacket can also become much safer with the water-air buoyant body attached thereto than that without it.

In addition, as shown in FIG. 20, the winged boat according to an embodiment of the present invention may further include an auxiliary buoyancy control part 800 in the lower portion of the main body 100. A plurality of auxiliary buoyancy control parts 800 may be installed to be spaced apart from each other along the bottom end of the edge of the main body 100, but the number and location of auxiliary buoyancy control part 800 may be variously applied as needed.

Here, the auxiliary buoyancy control part 800 is made of an elastic material such as rubber to be stretchable and provided with an inlet and an outlet that can be open and close for selectively injecting water W or air. Since the auxiliary buoyancy control part 800 can control buoyancy, the main body 100 does not easily tilt or capsize.

As a result, the present invention can prevent the boat from losing its balance and tilting or capsizing due to various factors such as strong wind and flooding, thereby preventing boating accidents in advance. In addition, since the buoyant wing part 200 can be accommodated in a reduced volume, it can be easily stored and transported. Furthermore, the reduced volume of the buoyant wing part 200 can reduce frictional resistance from water during operation, and thus the speed of the boat can increase.

In addition, since the buffer member 257 of the buoyant wing part 200 of the present invention buffers an external impact, the buoyant wing part 200 can be prevented from damage caused by impacts of surrounding structures. In addition, since the length of the main body 100 may change according to the number of passengers, the boat can be used conveniently.

Although specific embodiments of the winged boat according to the present invention have been described, it is apparent that various modifications are possible without departing from the scope of the present invention.

Therefore, the scope of the present invention should not be limited to the embodiments described above and should be defined by the appended claims and their equivalents.

That is, it should be understood that the embodiments described above are illustrative in all respects and not restrictive. The scope of the present invention is indicated by the appended claims rather than the detailed description, and all changes or modifications derived from the meaning and scope of the claims and their equivalents should be construed as being included in the scope of the present invention.

What is claimed is:

1. A winged boat comprising:

a main body with buoyancy, including a passenger space formed on an upper portion thereof and a closed space formed at an edge thereof, buoyant wing parts protruding from both sides of the main body, respectively disposed in a front area and a rear area of the main body spaced apart from each other, and each of the buoyant wing parts including:

a wing body protruded from a side of the main body with a certain length;

a buoyant space formed inside the wing body in a closed state;

a water storage part disposed in an opposite direction to the main body with respect to the buoyant space and having an opening and closing part operably provided at a lower portion thereof and an inlet formed at an upper portion thereof, and a buoyancy control part provided in an opposite direction to the buoyant space with respect to the water storage part and adjusting buoyancy of the wing body by controlling an amount of water stored therein, and a propulsive force generating part including:

a pair of rotating shafts forming horizontal rotation centers on both sides of the main body in a left and a right direction;

a pair of rotating blades parts rotatably installed on the rotating shafts, and a pair of rotating levers rotatably provided on both sides of the passenger space and mechanically connected to the rotating shafts, respectively, wherein the main body further includes a mounting groove concavely formed on both sides of the main body and having a length in a front and rear direction, wherein one longitudinal end of the wing body is rotatably coupled to a vertical rotation center formed in a front or a rear portion of the mounting groove, and when the wing body rotates toward a longitudinal direction of the main body, a width directional portion of the wing body is inserted into the mounting groove, wherein the buoyancy control part includes:

a storage space formed in an opposite direction to the buoyant space with respect to the water storage part;

an air passage extending from the storage space, exposed to an upper portion of the wing body, and communicating between the storage space and an outside of the wing body;

a water entrance vertically penetrating an upper portion of the storage space;

a lifting member provided in the inside of the storage space in an elevatable way, discharging water stored in the storage space through the water entrance when ascending, and discharging air in the storage space to the outside through the air passage when descending;

a control member rotatably provided in the main body, and a connecting cable having one longitudinal end connected to a top end of the lifting member and an opposite end wound around an outer side of the control member, wherein a handrail is provided with a certain height at an edge of the passenger space;

wherein a first fastening hole is vertically formed at a top end of the wing body, a second fastening hole is vertically penetrated through a top end of the handrail, and a fastening pin fixes the wing body being in an inserted state into the mounting groove, by vertically penetrating a lower portion of the fastening pin through the second fastening hole and the first fastening hole;

wherein the control members rotate in both directions by a rotational force of a driving part, a driving shaft of the driving part is mechanically connected to a rotation center of the control member to transmit the rotational force, and a manipulation part is electrically connected to the driving part so that a user can control an operation of the driving part;

wherein the driving part is further electrically connected to a control part, and an angle sensing part is further electrically connected to the control part, wherein the angle sensing part uses a gyro sensor to detect whether the main body is kept in a horizontal state, and when the main body tilts in one direction, the angle sensing part transmits an inclination detection signal of the main body to the control part, and the control part controls an operation of the driving part, wherein the winged boat further comprises a pair of rotation driving parts provided on both sides of the main body for transmitting a rotational force to the rotation shaft, wherein a driving shaft of the rotating driving part is mechanically connected to the rotating shaft, wherein an ON/OFF state and a rotation direction of the rotation driving part can be adjusted by using the control part, and one of the pair of rotation driving parts is selectively operated to adjust a driving direction of the main body.

2. The winged boat of claim 1, wherein the buoyancy control part is formed in an opposite direction to the buoyant space with respect to the water storage part and includes:

an installation groove a lower portion of which is vertically open downward;

a tube coupled to the inside of the installation groove, being capable of being expandable and contractible in a vertical direction, and having an accommodating space inside;

a water entrance penetrating vertically through an upper portion of the tube;

a plurality of air pumps provided in the main body and sucking or discharging air;

a connecting pipe having one longitudinal end that is connected to a top end of the tube and an opposite end that is opposite to the longitudinal end of the connecting pipe and connected to the air pump.

3. The winged boat of claim 1, further comprises:

a buoyant body connecting ring provided at an outer side of the buoyant wing part for coupling a substitute buoyant body;

a buffer member provided at a protruding end of the buoyant wing part, having a buffer space formed inside, and made of an elastic material that is expandable and contractible, and an auxiliary opening and closing part provided at one side of the buffer member, wherein the buffer member injects water to the inside or discharges water to the outside by opening or closing the auxiliary opening and closing part.

4. The winged boat of claim 1, wherein the main body includes: a front body positioned in a front portion; a rear body positioned in a rear portion, and one or more connecting block coupled between the front body and the rear body.

5. The winged boat of claim 1, further comprises:

an insertion groove concavely formed on both sides of the main body and a locking shoulder protruding from an inner circumferential surface of the insertion groove, wherein one longitudinal end of the wing body is slidably inserted into the insertion groove and has a locking protrusion protruding in its width direction, and when the wing body is slidingly withdrawn from the insertion groove, the locking protrusion is hooked on the locking shoulder, thereby limiting a withdrawn length of the wing body.

6. The winged boat of claim 1, further comprises a stopper that is provided on an upper portion of the inlet in a combinable and detachable way, wherein the stopper seals the water storage part when coupled to the inlet, and the stopper opens the water storage part upward when separated from the inlet.

7. The winged boat of claim 1, further comprises a plurality of auxiliary buoyancy control parts coupled to a lower portion of the main body, wherein the auxiliary buoyancy control parts are made of an elastic material to be that is stretchable and provided with an inlet and an outlet that can be open and close for selectively injecting water or air.

8. The winged boat of claim 1, further comprises:

a water play tube into which air is injected;

a life jacket that has buoyancy and can be worn on a user's upper body;

a seat belt storage box provided in the passenger space and accommodating a seat belt therein;

a buoyancy body connecting ring provided in the water play tube for coupling a substitute buoyancy body;

a first buoyancy air box provided along an edge of the water play tube, made of an elastic material that is stretchable, and having a water entrance configured to open and close for selectively injecting water or air, wherein the first buoyancy air box is provided with a stretchable air balloon formed inside and a water storage part formed inside for storing water, and a second buoyancy air box provided in the life jacket and made of an elastic material that is stretchable, wherein the second buoyancy air box is provided with an inlet and an outlet that can be open and close for selectively injecting water or air.

* * * * *